US011615764B2

(12) United States Patent
Kim et al.

(10) Patent No.: US 11,615,764 B2
(45) Date of Patent: Mar. 28, 2023

(54) ELECTRONIC DEVICE AND METHOD FOR CONTROLLING BRIGHTNESS OF DISPLAY

(71) Applicant: Samsung Electronics Co., Ltd., Gyeonggi-do (KR)

(72) Inventors: Jongah Kim, Gyeonggi-do (KR); Taejin Park, Gyeonggi-do (KR); Kyusung Kim, Gyeonggi-do (KR); Jeongho Cho, Gyeonggi-do (KR); Chihyun Cho, Gyeonggi-do (KR); Dongheon Shin, Gyeonggi-do (KR); Heewoong Yoon, Gyeonggi-do (KR); Kihyuk Lee, Gyeonggi-do (KR); Dongsun Lee, Gyeonggi-do (KR); Donghan Lee, Gyeonggi-do (KR); Gwangho Choi, Gyeonggi-do (KR)

(73) Assignee: Samsung Electronics Co., Ltd

( * ) Notice: Subject to any disclaimer, the term of this patent is extended or adjusted under 35 U.S.C. 154(b) by 0 days.

(21) Appl. No.: 17/161,097

(22) Filed: Jan. 28, 2021

(65) Prior Publication Data

US 2021/0248978 A1 Aug. 12, 2021

(30) Foreign Application Priority Data

Feb. 7, 2020 (KR) ..... 10-2020-0014741

(51) Int. Cl.
*G09G 3/20* (2006.01)
*G09G 5/10* (2006.01)

(52) U.S. Cl.
CPC ..... *G09G 5/10* (2013.01); *G09G 3/20* (2013.01); *G09G 2360/141* (2013.01); *G09G 2360/144* (2013.01); *G09G 2360/16* (2013.01)

(58) Field of Classification Search
CPC ..... G09G 5/10; G09G 3/20; G09G 2360/141; G09G 2360/144; G09G 2360/16
See application file for complete search history.

(56) References Cited

U.S. PATENT DOCUMENTS

2008/0218501 A1* 9/2008 Diamond ..... G09G 3/22 345/207
2009/0104941 A1 4/2009 Kwon et al.
(Continued)

FOREIGN PATENT DOCUMENTS

JP 2007163557 6/2007
JP 2014-153694 8/2014
(Continued)

OTHER PUBLICATIONS

International Search Report dated Apr. 26, 2021 issued in counterpart application No. PCT/KR2021/000739, 6 pages.

*Primary Examiner* — Stephen G Sherman
(74) *Attorney, Agent, or Firm* — The Farrell Law Firm, P.C.

(57) ABSTRACT

Disclosed is an electronic device including a processor configured to set a wake-up luminance of a display, based on a wake-up illuminance, to set, upon detecting an illuminance change through the illuminance sensor, a first target luminance of the display by using a first threshold illuminance value at a time point of detecting the illuminance change, to identify whether a flag setting related to an update of a threshold illuminance value is changed, while changing a luminance of the display based on the first target luminance, to determine the first target luminance as a final luminance of the display when there is no change in the flag setting, to update the first threshold illuminance value to a second threshold illuminance value when there is a change in the flag setting, and to change a target luminance of the display from the first target luminance to a second target luminance by using the second threshold illuminance value.

20 Claims, 11 Drawing Sheets

(56) References Cited

U.S. PATENT DOCUMENTS

| | | | | |
|---|---|---|---|---|
| 2011/0134091 | A1* | 6/2011 | Chen | G09G 3/3406 345/207 |
| 2012/0235966 | A1 | 9/2012 | Tanaka | |
| 2014/0092119 | A1 | 4/2014 | Jung et al. | |
| 2016/0240167 | A1* | 8/2016 | Breazile | G09G 3/3406 |
| 2018/0348049 | A1 | 12/2018 | Yoon et al. | |
| 2020/0328260 | A1* | 10/2020 | Tang | H01L 27/3227 |

FOREIGN PATENT DOCUMENTS

| | | |
|---|---|---|
| JP | 2014-154348 | 8/2014 |
| JP | 2014175780 | 9/2014 |
| KR | 1020090041256 | 4/2009 |
| KR | 1020130044936 | 5/2013 |
| KR | 1020140042578 | 4/2014 |

* cited by examiner

ELECTRONIC DEVICE AND METHOD FOR CONTROLLING BRIGHTNESS OF DISPLAY

CROSS-REFERENCE TO RELATED APPLICATION(S)

This application is based on and claims priority under U.S.C. § 119 to Korean Patent Application No, 10-2020-0014741, filed on Feb. 7, 2020, in the Korean intellectual Property Office, the content of which is incorporated herein by reference in its entirety.

BACKGROUND

1. Field

The disclosure relates generally to an electronic device, and more particularly, to an electronic device and method for adjusting brightness of a display on the electronic device depending on ambient light.

2. Description of Related Art

With the recent developments in digital technologies, a large variety of electronic devices such as a mobile communication terminal, a smart phone, a tablet personal computer (PC), a notebook, or a wearable device are in use worldwide.

The electronic device may include a display capable of visually displaying information and/or contents, and may provide a function of adjusting the brightness, contrast, and/or luminance of the display. Particularly, the electronic device may have a function of detecting ambient light through an illuminance sensor and automatically-adjusting the brightness of the display in response to the ambient light. The illuminance sensor of the electronic device may be installed in an inactive area (e.g., a bezel mounting structure) of the display or in an active area (e.g., a sub-panel mounting structure) of the display.

Nevertheless, in certain low-illuminance environments, detecting the ambient light may be inaccurate or difficult. Thus, when the user moves to a dark environment, the display may undesirably operate with a brightness darker or brighter than the brightness corresponding to the ambient light.

As such, there is a need in the art for a method and apparatus that compensate for this problem of detecting the ambient light, to improve the display operation of the electronic device in various lighting conditions.

SUMMARY

The disclosure is provided to address at least the above-mentioned problems and/or disadvantages and to provide at least the advantages described below.

Accordingly, an aspect of the disclosure is to provide an electronic device and method capable of improving an automatic brightness control operation of a display in an environment in which an illuminance sensor fails to output an accurate measurement value.

Another aspect of the disclosure is to provide an electronic device and method for controlling the brightness of a display, based on a predetermined threshold illuminance value instead of a measured illuminance value of an illuminance sensor, when the electronic device moves from a bright location to a dark location. This can prevent or reduce user's glare in a dark environment.

Another aspect of the disclosure is to provide an electronic device and method capable of increasing an illuminance sensing accuracy of an illuminance sensor by controlling an illuminance measurement time (also referred to as an integration time) of an illuminance sensor, based on a plurality of threshold illuminance values.

Another aspect of the disclosure is to provide an electronic device and method capable of changing an integration time of an illuminance sensor and/or an operating condition of a display (e.g., a target luminance) when controlling the brightness of the display, based on ambient light detected by the illuminance sensor.

Another aspect of the disclosure is to provide an electronic device and method capable of giving a smooth and natural brightness control effect to a user by gradually reaching a target luminance of a display suitable for a user's environment.

In accordance with an aspect of the disclosure, an electronic device may include a display, an illuminance sensor, and a processor operatively connected to the display and the illuminance sensor. The processor may be configured to set a wake-up luminance of the display, based on a wake-up illuminance, to set, upon detecting an illuminance change through the illuminance sensor, a first target luminance of the display by using a first threshold illuminance value at a time point of detecting the illuminance change, to identify whether a flag setting related to an update of a threshold illuminance value is changed, while changing a luminance of the display based on the first target luminance, to determine the first target luminance as a final luminance of the display when there is no change in the flag setting, to update the first threshold illuminance value to a second threshold illuminance value when there is a change in the flag setting, and to change a target luminance of the display from the first target luminance to a second target luminance by using the second threshold illuminance value.

In accordance with another aspect of the disclosure, an operating method of an electronic device may include setting a wake-up luminance of a display, based on a wake-up illuminance; setting, upon detecting an illuminance change through an illuminance sensor, a first target luminance of the display by using a first threshold illuminance value at a time point of detecting the illuminance change; identifying whether a flag setting related to an update of a threshold illuminance value is changed, while changing a luminance of the display based on the first target luminance; determining the first target luminance as a final luminance of the display when there is no change in the flag setting; updating the first threshold illuminance value to a second threshold illuminance value when there is a change in the flag setting; and changing a target luminance of the display from the first target luminance to a second target luminance by using the second threshold illuminance value.

In addition, various embodiments of the disclosure may provide a non-transitory computer-readable recording medium that stores a program for executing the above method in a processor.

BRIEF DESCRIPTION OF THE DRAWINGS

The above and other aspects, features and advantages of certain embodiments of the disclosure will be more apparent from the following detailed description, taken in conjunction with the accompanying drawings, in which.

DETAILED DESCRIPTION

Embodiments of the disclosure will be described in detail with reference to the accompanying drawings. Detailed descriptions of known functions and/or configurations will be omitted for the sake of clarity and conciseness.

Figure 1:
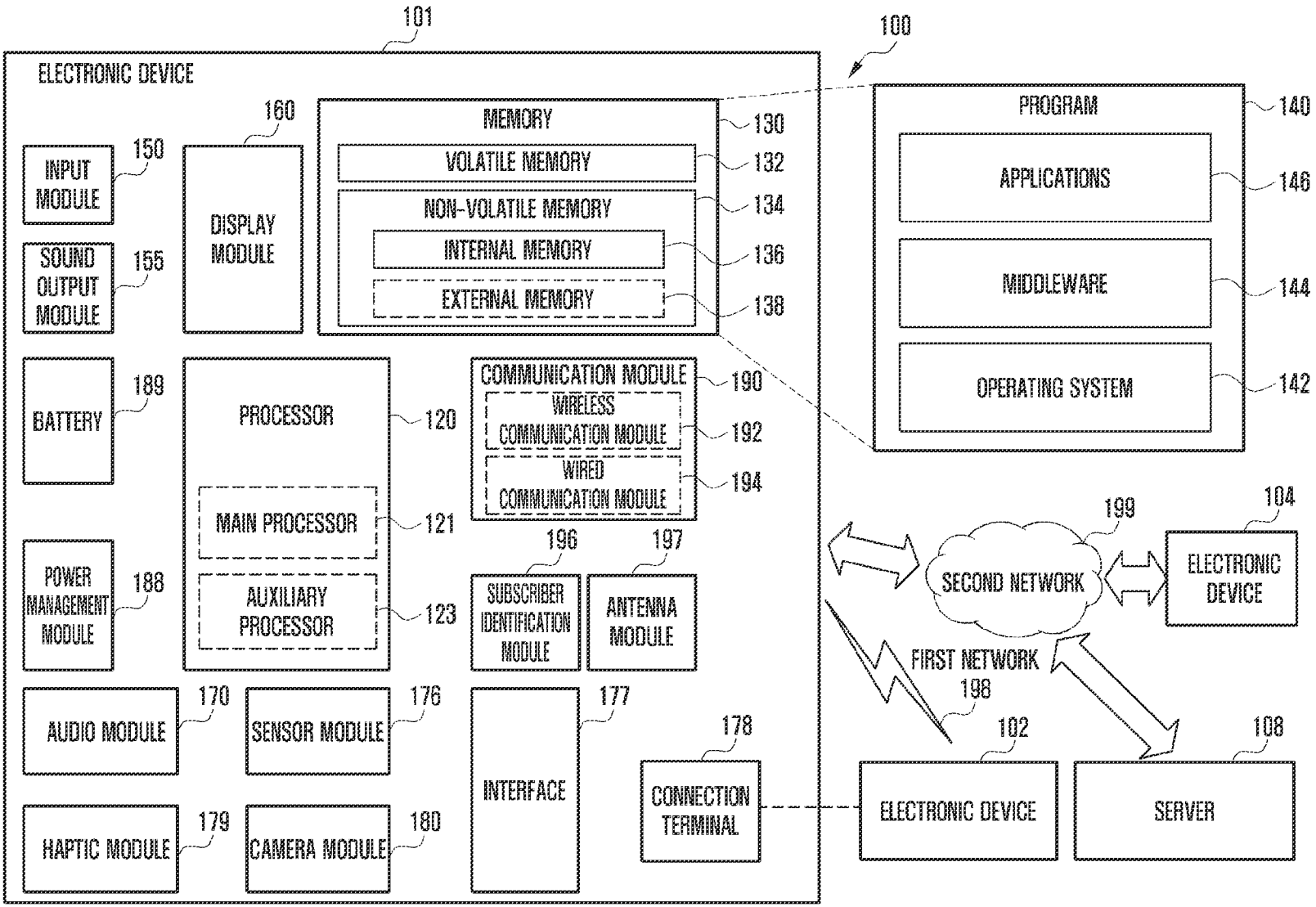
FIG. 1 illustrates an electronic device in a network environment according to an embodiment.

FIG. 1 illustrates an electronic device 101 in a network environment 100 according to an embodiment.

Referring to FIG. 1, the electronic device 101 in the network environment 100 may communicate with an electronic device 102 via a first network 198 (e.g., a short-range wireless communication network), with an electronic device 104 or a server 108 via a second network 199 (e.g., a long-range wireless communication network), or with the electronic device 104 via the server 108, and may include a processor 120, a memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) card 196, and an antenna module 197. At least one (e.g., the display device 160 or the camera module 180) of the components may be omitted from the electronic device 101, or one or more other components may be added in the electronic device 101. Some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute software (e.g., a program 140) to control at least one other component (e.g., a hardware or software component) of the electronic device 101 coupled with the processor 120 and may perform various data processing or computation. The processor 120 may load a command or data received from another component (e.g., the sensor module 176 or the communication module 190) in the volatile memory 132, process the command or the data stored in the volatile memory 132, and store resulting data in non-volatile memory 134. The processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). The auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101 and may include software (e.g., the program 140) and input data or output data for a command related thereto. The memory 130 may include the volatile memory 132 or the non-volatile memory 134.

The program 140 may be stored in the memory 130 as software, and may include an operating system (OS) 142, middleware 144, or an application 146.

The input device 150 may receive a command or data to be used by another component (e.g., the processor 120) of the electronic device 101, from the outside (e.g., a user) of the electronic device 101, and may include a microphone, a mouse, a keyboard, or a digital pen (e.g., a stylus pen).

The sound output device 155 may output sound signals to the outside of the electronic device 101 and may include a speaker or a receiver. The speaker may be used for general purposes, such as playing multimedia or playing record, and the receiver may be used for incoming calls and may be implemented as separate from, or as part of the speaker.

The display device 160 may visually provide information to the outside (e.g., a user) of the electronic device 101 and may include a display, a hologram device, or a projector and control circuitry to control a corresponding one of the display, hologram device, and projector. The display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa, and may obtain the sound via the input device 150, or output the sound via the sound output device 155 or a headphone of an external electronic device (e.g., an electronic device 102) directly (e.g., over wires) or wirelessly coupled with the electronic device 101.

The sensor module 176 may detect an operational state (e.g., power or temperature) of the electronic device 101 or an environmental state (e.g., a state of a user) external to the electronic device 101, and generate an electrical signal or data value corresponding to the detected state, and may include a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., over wires) or wirelessly, and may include a high definition multimedia interface (IMMI), a universal serial bus (USB) interface, a secure digital (SD) card interface, or an audio interface.

A connecting terminal 178 may include a connector via which the electronic device 101 may be physically connected with the external electronic device (e.g., the electronic device 102), and may include an HDMI connector, a USB connector, an SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation, and may include a motor, a piezoelectric element, or an electric stimulator.

The camera module 180 may capture a still image or moving images and may include one or more lenses, image sensors, image signal processors, or flashes.

The power management module 188 may manage power supplied to the electronic device 101, and may be implemented as at least part of a power management integrated circuit (PMIC).

The battery 189 may supply power to at least one component of the electronic device 101 and may include a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. The communication module 190 may include a wireless communication module 192 (e.g., a cellular communication module, a short-range wireless communication module, or a global navigation satellite system (GLASS) communication module) or a wired communication module 194 (e.g., a local area network (LAN) communication module or a power line communication (PLC) module), A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., a LAN or a wide area network (WAN)). These various types of communication modules may be implemented as a single component (e.g., a single chip), or may be implemented as multi components (e.g., multi chips) separate from each other.

The wireless communication module 192 may identify and authenticate the electronic device 101 in a communication network, such as the first network 198 or the second network 199, using subscriber information (e.g., international mobile subscriber identity (IMSI)) stored in the SIM 196.

The antenna module 197 may transmit or receive a signal or power to or from the outside (e.g., the external electronic device) of the electronic device 101 and may include an antenna including a radiating element composed of a conductive material or a conductive pattern formed in or on a substrate (e.g., a PCB). The antenna module 197 may include a plurality of antennas. In such a case, at least one antenna appropriate for a communication scheme used in the communication network, such as the first network 198 or the second network 199, may be selected by the communication module 190 (e.g., the wireless communication module 192) from the plurality of antennas. The signal or the power may then be transmitted or received between the communication module 190 and the external electronic device via the selected at least one antenna. Another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIDI)).

Commands or data may be transmitted or received between the electronic device 101 and the external electronic device 104 via the server 108 coupled with the second network 199. Each of the electronic devices 102 and 104 may be a device of a same type as, or a different type, from the electronic device 101.

All or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request and transfer an outcome of the performing to the electronic device 101. The electronic device 101 may provide the outcome, with or without further processing, as at least part of a reply to the request. To that end, a cloud, distributed, or client-server computing technology may be used, for example.

Figure 2:
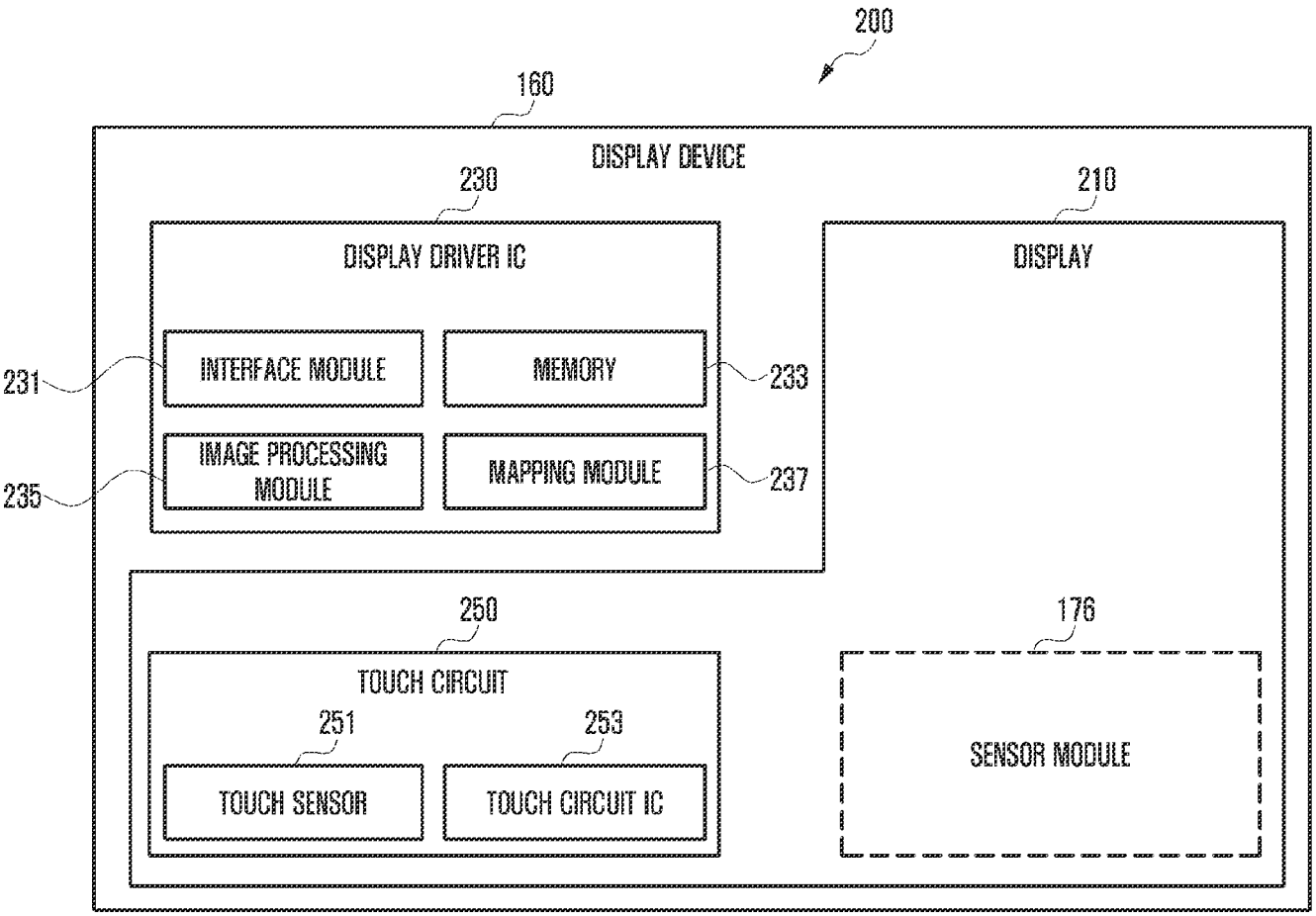
FIG. 2 is a block diagram illustrating a display device according to an embodiment.

FIG. 2 is a block diagram 200 illustrating the display device 160 according to an embodiment.

Referring to FIG. 2, the display device 160 may include a display 210 and a display driver integrated circuit (DDI) 230 to control the display 210. The DDI 230 may include an interface module 231, memory 233 (e.g., buffer memory), an image processing module 235, or a mapping module 237.

The DDI 230 may receive image information that contains image data or an image control signal corresponding to a command to control the image data from another component of the electronic device 101 via the interface module 231. For example, The image information may be received from the processor 120 (e.g., the main processor 121 (e.g., an application processor)) or the auxiliary processor 123 (e.g., a graphics processing unit) operated independently from the function of the main processor 121. The DDI 230 may communicate with touch circuitry 350 or the sensor module 176 via the interface module 231. The DDI 230 may also store at least part of the received image information in the memory 233 on a frame-by-frame basis.

The image processing module 235 may perform pre-processing or post-processing (e.g., adjustment of resolution, brightness, or size) with respect to at least part of the image data. The pre-processing or post-processing may be performed based at least in part on one or more characteristics of the image data or one or more characteristics of the display 210.

The mapping module 237 may generate a voltage value or a current value corresponding to the image data pre-processed or post-processed by the image processing module 235. The generating of the voltage value or current value may be performed based at least in part on one or more attributes of the pixels (e.g., an array, such as an RGB stripe or a pentile structure, of the pixels, or the size of each subpixel). At least some pixels of the display 210 may be driven based at least in part on the voltage value or the current value such that visual information (e.g., a text, an image, or an icon) corresponding to the image data may be displayed via the display 210.

The display device 160 may further include the touch circuitry 250. The touch circuitry 250 may include a touch sensor 251 and a touch sensor IC 253 to control the touch sensor 251. The touch sensor IC 253 may control the touch sensor 251 to sense a touch input or a hovering input with respect to a certain position on the display 210. To achieve this, the touch sensor 251 may detect (e.g., measure) a change in a signal (e.g., a voltage, a quantity of light, a resistance, or a quantity of one or more electric charges) corresponding to the certain position on the display 210. The touch circuitry 250 may provide input information (e.g., a position, an area, a pressure, or a time) indicative of the touch input or the hovering input detected via the touch sensor 251 to the processor 120. According to an embodiment, at least part (e.g., the touch sensor IC 253) of the touch circuitry 250 may be formed as part of the display 210 or the DDI 230, or as part of another component (e.g., the auxiliary processor 123) disposed outside the display device 160.

The display device 160 may further include at least one sensor (e.g., a fingerprint sensor, an iris sensor, a pressure sensor, or an illuminance sensor) of the sensor module 176 or a control circuit for the at least one sensor. In such a case, the at least one sensor or the control circuit for the at least one sensor may be embedded in one portion of a component (e.g., the display 210, the DDI 230, or the touch circuitry 250)) of the display device 160. For example, when the sensor module 176 embedded in the display device 160 includes a biometric sensor (e.g., a fingerprint sensor), the biometric sensor may obtain biometric information (e.g., a fingerprint image) corresponding to a touch input received via a portion of the display 210. As another example, when the sensor module 176 embedded in the display device 160 includes a pressure sensor, the pressure sensor may obtain pressure information corresponding to a touch input received via a partial or whole area of the display 210. The touch sensor 251 or the sensor module 176 may be disposed between pixels in a pixel layer of the display 210, or over or under the pixel layer.

The electronic device 101 according to embodiments may be one of various types of electronic devices, such as a portable communication device (e.g., a smartphone), a computer device, a portable multimedia device, a portable medical device, a camera, a wearable device, or a home appliance. However, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment, With regard to the description of the drawings, similar reference numerals may be used to refer to similar or related elements. It is to be understood that a singular form of a noun corresponding to an item may include one or more of the things, unless the relevant context clearly indicates otherwise.

As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases. As used herein, such terms as "1st" and "2nd", or "first" and "second" may be used to simply distinguish a corresponding component from another and does not limit the components in other aspect (e.g., importance or order). It is to be understood that if an element (e.g., a first element) is referred to, with or without the term "operatively" or "communicatively", as "coupled with", "coupled to", "connected with", or "connected to" another element (e.g., a second element), it means that the element may be coupled with the other element directly (e.g., over wires) wirelessly, or via a third element.

As used herein, the term "module" may include a unit implemented in hardware, software, or firmware, and may interchangeably be used with other terms such as "logic", "Logic block", "part", or "circuitry", A module may be a single integral component, or a minimum unit or part thereof, adapted to perform one or more functions. For example, The module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium, Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

In the disclosure, an electronic device and method can prevent user's glare and reduce user's eye fatigue in an automatic brightness control function of a display when the user moves from a bright location to a dark location. The electronic device and method can control the brightness of the display, based on a predetermined threshold illuminance value instead of a measured illuminance value of an illuminance sensor, in an environment in which the illuminance sensor fails to output an accurate measurement value (e.g., in case of moving from a bright location to a dark location), thereby preventing or reducing user's glare in a dark environment and giving a smooth and natural brightness control effect to the user. The electronic device and method can increase an illuminance sensing accuracy of the illuminance sensor by controlling an illuminance measurement time an integration time) of the illuminance sensor, based on a plurality of threshold illuminance values, in low-illuminance environments.

Figure 3:
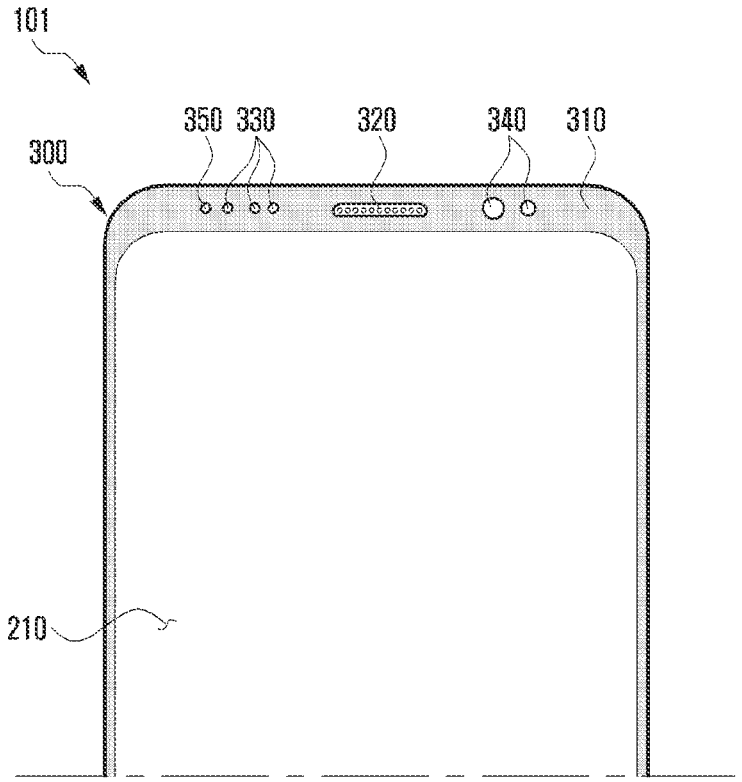
FIG. 3 illustrates an example of an electronic device according to an embodiment.
Figure 4:
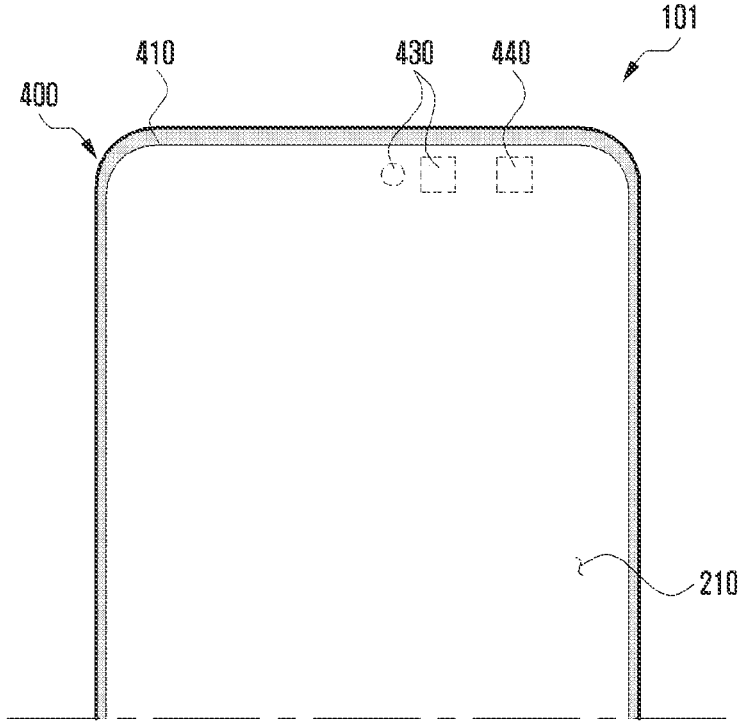
FIG. 4 illustrates another example of an electronic device according to an embodiment.

FIG. 3 illustrates an example of an electronic device 101 according to a first embodiment. FIG. 4 illustrates another example of an electronic device 101 according to a second embodiment.

FIGS. 3 and 4 illustrate a structure in which a sensor circuit or module (e.g., a proximity sensor, an illuminance sensor, and/or a combination thereof) according to embodiments is mounted in the electronic device 101.

Referring to FIGS. 3 and 4, the electronic device 101 may include a housing 300 or 400 composed of a front surface, a rear surface, and a lateral surface surrounding a space between the front and rear surfaces. Alternatively, the housing 300 or 400 may form a part of the front, rear, and lateral surfaces.

The front surface may be formed of a front plate 310 or 410 (e.g., a glass plate having various coating layers, or a polymer plate) that is substantially transparent. The rear surface may be formed of a substantially opaque rear plate (not shown), such as of a coated or colored glass, a ceramic, a polymer, a metal (e.g., aluminum, stainless steel (STS), or magnesium), or a combination thereof. The lateral surface is combined with the front plate 310 or 410 and the rear plate and may be formed of a lateral bezel structure (or a lateral member) having a metal and/or a polymer. The rear plate and the lateral bezel structure may be integrally formed of the same material, such as aluminum).

The display 210 may be exposed through a considerable portion of the front plate 310 or 410. The display 210 may be implemented in any form including a liquid crystal display (LCD), an organic light emitting diode (OLED), or an active matrix GEED (AMOLED). The display 210 may display a moving image or a still image under the control of a processor (e.g., the processor 120 in FIG. 1), and may receive an input from an external object (e.g., a user finger or a stylus pen). In order to receive this input, the display 210 may include a touch sensor 251. The display 210 may be combined with or disposed near a touch sensing circuit (or touch sensor), a pressure sensor for measuring the intensity (pressure) of a touch, and/or a digitizer for detecting a magnetic field type stylus pen.

In FIG. 3, a sensor module 330 including a proximity sensor, an illuminance sensor, and/or a combination thereof may be mounted on the front plate 310 of the electronic device 101. Referring to FIG. 3, the electronic device 101 of the first embodiment may include the housing 300 having the front plate 310 and also include the display 210, a sound output device 320, the sensor module 330, a camera module 340, and/or an indicator 350 on the front plate 310. Alternatively, the electronic device 101 may not include at least one of the above components or may further include any other suitable component.

According to the second embodiment, in FIG. 4, a sensor module 430 including a proximity sensor, an illuminance sensor, and/or a combination thereof may be mounted beneath the display 210 as a sub-panel of the display 210. Referring to FIG. 4, the electronic device 101 may include the display 210, the housing 400*a* having the front plate 410, the sensor module 430, and a camera module 440 beneath the display 210. Although not shown in FIG. 4, the electronic device 101 may further include any other component (e.g., the sound output device 320 and/or the indicator 350) as described above in FIG. 3. In the electronic device 101 shown in FIG. 4, the sound output device 320 may be disposed at an edge of a bezel area. The electronic device 101 shown in FIG. 4 may include a sub-panel speaker using the display 210 (e.g., OLED) as a diaphragm. For example, the sub-panel speaker may be mounted under the display 210 so as not to be visible in appearance.

The sound output device 320 may include a speaker having a receiver for a telephone call. The sensor module 330 or 430 may generate electric signals or data values corresponding to an internal operating state of the electronic device 101 or an external environment. The sensor module 330 or 430 may include a proximity sensor, an illuminance sensor, and/or a combination thereof. The proximity sensor may detect an external object in the proximity of the electronic device 101 and may be composed of a light emitter that emits infrared rays and a light receiver that receives infrared rays reflected by an external object. The illuminance sensor may measure illuminance around the electronic device 101, such as ambient light, and represent the ambient light as the unit of lux. The illuminance sensor may measure illuminance in a manner of measuring the amount of light through a specific-sized hole.

The camera module 340 or 440 may be composed of one or more lenses, an image sensor, and/or an image signal processor. Two or more lenses (e.g., wide-angle and telephoto lenses) and image sensors may be disposed on one surface (e.g., front or rear surface) of the electronic device 101. The indicator 350 may provide state information of the electronic device 101 in an optical form and may provide a light source used for the camera module 310 or 440. The indicator 350 may include a luminous element such as a light emitting diode (LED), an infrared (IR) LED, a laser diode (LD), or a xenon lamp.

The sensor module 330 may be disposed on the front plate 310 of the housing 300 as shown in FIG. 3, or may be disposed beneath the display 210 between the front and rear surfaces of the housing 400 as shown in FIG. 4. For example, the electronic device 101 may include an illuminance sensor that is disposed in the inactive area of the display 210 and measures illuminance (or ambient light) to be used for adjusting the brightness of the display 210. In another example, the electronic device 101 may include an illuminance sensor that is disposed in an active area of the display 210 and measures, at a display-off time (or a display-off zone), illuminance (or ambient light) to be used for adjusting the brightness of the display 210. The electronic device 101 may correct an illuminance measurement value by using color-on-pixel ratio (COPR) information. For example, the illuminance sensor may measure illuminance only at the display-off time to minimize the influence from the display 210, and further correct the illuminance measurement value, based on a color displayed on the display 210.

The display-off time of the display 210 may indicate a time during which the illuminance sensor is not affected by the brightness of the display 210 when sensing illuminance. For example, the display-off time may be used to control timing to reduce the influence of illuminance measurement due to a display operation of the display 210. The COPR information may be used to correct an illuminance measurement value, based on a color displayed on the display 210. For example, a correction value may be differently applied depending on a bright color (e.g., white) and a dark color (e.g., black). For example, if a large amount of red is present among colors displayed on the display 210, the value of the R channel among red, green, and blue (RGB) channels of the illuminance sensor may have a high output; therefore, the R channel value of the illuminance sensor may be corrected.

The display 210 of the electronic device 101 may be implemented as a bezel-less display with an increased area occupied on the front surface, and thus components such as the sensor module 430 and the camera module 440 having been disposed on the front surface may be disposed between the display 210 and the rear surface or disposed inside the display 210. For example, the proximity sensor, the illuminance sensor, and/or the camera module 440 may be disposed as a sub-display sensor structure between the display 210 and the rear surface (or a sub-panel beneath the display 210). Alternatively, the proximity sensor, the illuminance sensor, and/or the camera module 440 may be disposed as an intra-display sensor structure in the display 210 by being integrated with the display 210. In case of the intra-display sensor structure, sensors (e.g., the proximity sensor, the illuminance sensor, and/or the camera module 440) may be directly deposited on the cell as in the on-cell touch AMOLED (OCTA) structure which is a type of touch screen panel technology.

As the area occupied by the display 210 on the front surface increases, the area for disposing various components on the front surface is decreasing. That is, because the area occupied by the display 210 increases and the bezel area becomes relatively narrow, it is difficult to dispose electronic components side by side with the display 210. Therefore, the tendency of disposing electronic components between the display 210 and the rear plate or in the display 210 is increasing.

When the illuminance sensor is disposed between the display 210 and the rear plate (or a sub-panel), the illuminance sensor may be affected by the brightness of the display 210 when measuring illuminance. Thus, the measurement operation of the illuminance sensor may further consider the brightness of the display 210 to increase the accuracy of measurement information (e.g., illuminance values). For example, it is possible to set in integration time (e.g., the minimum operation time for illuminance sensing) of the illuminance sensor to be short and measure the illuminance value in an off-zone per frame (e.g., 1 duty duration of about 16.6 milliseconds (ms)) during the on/off operation of the display 210. For example, when the illuminance sensor is disposed in the active area of the display 210, the illuminance sensor may measure illuminance (or ambient light) at the display-off time. The electronic device 101 may correct the illuminance measurement value by using COPR information. For example, the illuminance sensor may measure illuminance only at the display-off time to minimize the influence from the display 210, and further correct the illuminance measurement value, based on the color displayed on the display 210.

When the integration time (e.g., the minimum operation time for illuminance sensing) of the illuminance sensor is set to be short, the illuminance sensor may fail to output a sensor value a measured illuminance value) because the accuracy of illuminance sensing is decreased in low-illuminance environments due to the insufficiency of sensitivity (e.g., the degree of an output of the illuminance sensor in response to an input) for illuminance measurement. For example, the illuminance sensor may fail to identify light at a certain illuminance or less (e.g., about 5 lux) due to insufficient sensitivity. Accordingly, the illuminance sensor may set a threshold illuminance value (or minimum lux) to prevent incorrect operations (e.g., failing to output a sensor value or outputting approximately 0 lux in a low illuminance). The threshold illuminance value (or minimum lux) is defined as a threshold value that is set to prevent incorrect operations caused by insufficient sensitivity of the illuminance sensor at a specific illuminance or less (e.g., a low-illuminance environment). For example, the threshold illuminance value may indicate the minimum illuminance value (or a limit value) for outputting a predetermined illuminance value in an incorrect operation condition.

If the display 210 is set to be bright in a structure that the illuminance sensor is disposed in the active area of the display 210 (e.g., in the sub-panel sensor environment), the display-on zone is increased and the display-off zone is decreased. Thus, the integration time of the illuminance sensor may become shortened in proportion to the decrease in the display-off zone. In this case, even if the electronic device 101 enters a slightly dark environment, the illuminance sensor may measure the illuminance as close to about 0 lux because of low sensitivity, and therefore the brightness (luminance) of the display 210 may become too dark suddenly. In order to prevent this problem, it is desirable to set the threshold illuminance value (e.g., minimum lux) indicating a lower limit of illuminance measurement.

The illuminance sensor may control incorrect operations at a specific illuminance or less through the threshold illuminance value. Due to the threshold illuminance value, the illuminance sensor may output a higher illuminance value (e.g., a threshold illuminance value) rather than an illuminance value based on ambient light, and the display 210 may operate with a certain brightness according to the threshold illuminance value higher rather than the ambient brightness. For example, the luminance of the display 210

(e.g., the brightness outputted by the display 210, unit: cd/m$^2$) may be set to higher than the ambient light in a very low illuminance environment such as a darkroom (e.g., about 0 lux to about 2 lux) due to the threshold illuminance value, thereby causing the user to feel the glare. For example, when the electronic device 101 with the high luminance of the display 210 in a bright environment suddenly enters a very low illuminance environment such as a darkroom (e.g., about 0 lux to about 2 lux), the illumination sensor may output an illuminance value (e.g., about 50 lux) higher than the lowest illuminance value because of the threshold illuminance value (min lux). Thus, the display 210 may be set to the luminance (e.g., a screen brightness corresponding to about 50 lux) brighter than the ambient light. As a result, the user may feel a glare due to the bright luminance of the display 210 in a dark environment (e.g., a darkroom).

When failing to change a luminance to be suitable for ambient light due to a threshold illuminance value of the illuminance sensor, the electronic device 101 may enable the illuminance sensor to provide a more suitable illuminance value for ambient light by changing (or updating) the threshold illuminance value. For example, when identifying a designated (or initially set) threshold illuminance value through monitoring using the illuminance sensor (e.g., when the measured illuminance value is the threshold illuminance value), the electronic device 101 may set a flag (e.g., a threshold illuminance flag or a min lux flag). For example, when the flag is set to '1', the electronic device 101 may identify the flag and perform a particular operation, such as periodically reading a sensor value of the illuminance sensor in a polling manner, identifying the flag, and if the flag setting is changed, performing a corresponding operation. For example, the electronic device 101 may identify the final threshold illuminance value while changing step by step the threshold illuminance value based on the flag. Then, based on the identified final threshold illuminance value, the electronic device 101 may set the luminance of the display 210 to be more suitable (or optimized) for the ambient light. As a result, the electronic device 101 may provide the optimized brightness of the display 210 to the user even in a sudden change to a dark environment.

The electronic device 101 may enhance the illuminance sensing accuracy by controlling an integration time of the illuminance sensor based on a plurality of threshold illuminance values depending on platform codes (or brightness levels) of the display 210. In addition, the electronic device 101 may control the operation of the display 210 to be suitable for the ambient light, based on the threshold illuminance value that varies. Specifically, when the flag is set under a designated condition, the electronic device 101 may change the threshold illuminance value accordingly and change a target luminance of the display 210 based on the threshold illuminance value. The flag may have a variable (e.g., information about a specific situation) that indicates a change state of the threshold illuminance value. For example, the flag may contain a promised signal (or command or predefined bit) that instructs, upon detecting a designated condition (e.g., a designated platform code), to update the current threshold illuminance value to the threshold illuminance value corresponding to the platform code. The electronic device 101 may declare one variable for the flag and store a state of updating the threshold illuminance value in the corresponding variable. For example, if the flag is '1', this may indicate the updated state of the threshold illuminance value.

Figure 5:
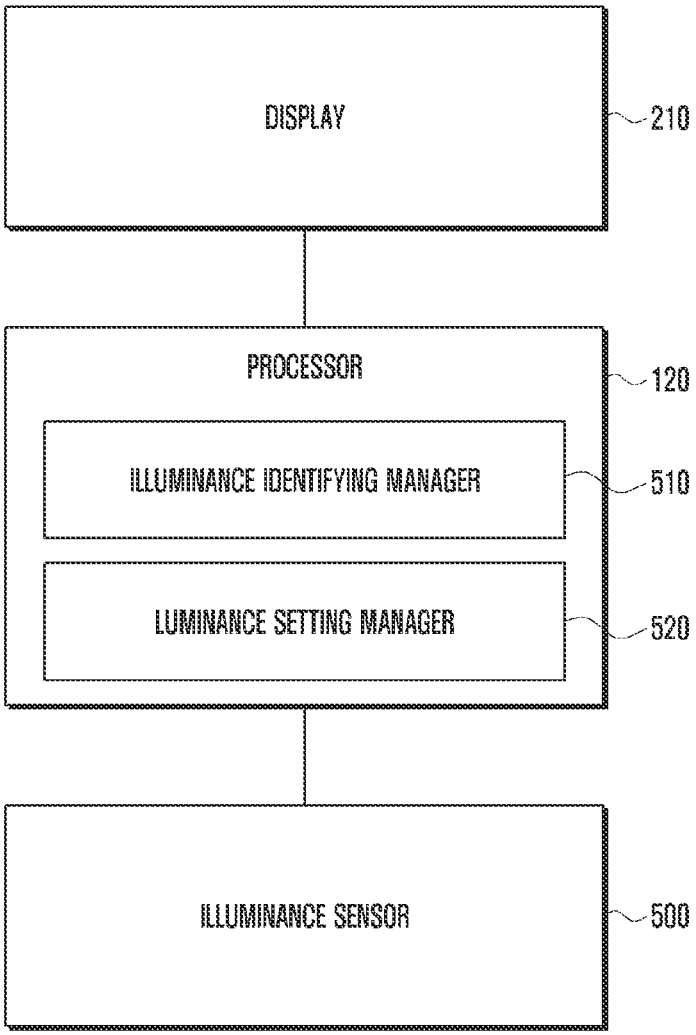
FIG. 5 is a block diagram schematically illustrating the configuration of an electronic device according to an embodiment.

FIG. 5 is a block diagram schematically illustrating the configuration of an electronic device according to an embodiment.

Referring to FIG. 5, the electronic device 101 includes the display 210, an illuminance sensor 500 (or an ambient light sensor, a combination of a proximity sensor and an illuminance sensor, or a sensor circuit), and the processor 120.

The display 210 may visually offer information to the user. The display 210 may include the touch circuitry 250 as shown in FIG. 2 and, based on the touch circuitry 250, detect a touch input or a hovering input (or proximity input) by measuring a change in signals (e.g., voltage, amount of light, resistance, or charge amount) with respect to a certain position on the display 210.

The display 210 may operate with certain brightness based on corresponding luminance determined through manual brightness adjustment by a user input or automatic brightness adjustment by an illuminance value measured by the illuminance sensor 500 under the control of the processor 120. As shown in Table 1 below, the luminance of the display 210 may be adjusted based on a platform code (or brightness level) table (or luminance table). The platform code table may be stored in the memory 130

TABLE 1

| Platform Code (code) | Illuminance (lux) | Luminance (cd/m$^2$) | Hysteresis | |
|---|---|---|---|---|
| | | | Down Hysteresis | Up Hysteresis |
| 1 | $X_1$ | $L_1$ (e.g., about 10) | $DH_1$ | $UH_1$ |
| 2 | $X_2$ | $L_2$ (e.g., about 15) | $DH_2$ | $UH_2$ |
| 3 | $X_3$ | $L_3$ (e.g., about 20) | $DH_3$ | $UH_3$ |
| 4 | $X_4$ | $L_4$ (e.g., about 25) | $DH_4$ | $UH_4$ |
| 5 | $X_5$ | $L_5$ (e.g., about 30) | $DH_5$ | $UH_5$ |
| 6 | $X_6$ | $L_6$ (e.g., about 35) | $DH_6$ | $UH_6$ |
| ... | ... | ... | ... | ... |
| 255 | $X_{255}$ | $L_{255}$ (e.g., about 500) | $DH_{255}$ | $UH_{255}$ |

As shown in Table 1, a platform code (e.g., 1 to 255) may be used to adjust the luminance of the display 210, and a luminance value corresponding to each code may be set. The automatic brightness control function of the display 210 is a function by which the processor 120 (or a designated application such as a power manager service (PMS) application) acquires an illuminance value (e.g., $X_1$ to $X_{255}$ wherein X denotes a specific illuminance value or range a range between the minimum illuminance and the maximum illuminance within a corresponding section)) in real time from the illuminance sensor 500 and then adjusts the luminance (or brightness) of the display 210 as a luminance value (e.g., $L_1$ to $L_{255}$ wherein L denotes a specific luminance value or range (e.g., a range between the minimum luminance and the maximum luminance within a corresponding code)) which is set to a platform code (e.g., 1 to 255) corresponding to the acquired illuminance value. The manual brightness control function of the display 210 allows the user to manually set the brightness of the display 210, In the manual brightness control function, the processor 120 may identify a platform code (e.g., 1 to 255) corresponding to a position of a user input (e.g., a UI dragging position) and then adjust the luminance as a luminance value (e.g., $L_1$ to $L_{255}$) set to the platform code.

The display 210 may determine a corresponding luminance (e.g., wake-up luminance), based on an illuminance value (e.g., wake-up illuminance) measured by the illuminance sensor 500 immediately before wake up (or power turn on), and may be turned on with a brightness corresponding to the determined luminance. The wake-up luminance denotes a luminance when the display 210 is turned on, and the wake-up luminance may be determined based on an illuminance value, i.e., wake-up illuminance, immediately before the display 210 is turned on.

As shown in Table 1, hysteresis (e.g., down hysteresis (DH) and up hysteresis (UH)) may be set according to the platform code. The hysteresis may represent a difference in a characteristic curve between an input (X) and an output (L) (e.g., luminance according to a change in illuminance) when the input (X) (e.g., illuminance measurement value) increases or decreases. For example, the DH may include a lower limit value for detection of a decrease in brightness of the illuminance sensor 500, and the UH may include an upper limit value for detection of an increase in brightness of the illuminance sensor 540.

The hysteresis prevents an inconvenience to the user due to changes in luminance caused by frequent changes in illuminance. The hysteresis setting provides a range in which no change in luminance occurs. For example, if the illuminance measured before the display 2:1.0 wakes up (i.e., the wake-up illuminance) is $X_1$ (e.g., about 10 lux), the DH may be set to $DH_1$ (e.g., about 5 lux), and the UH may be set to UK (e.g., about 122 lux). In this case, the display 210 may operate with the same first luminance in an illuminance within a range of $DH_1<X_1<UH_1$. In addition, the display 210 may operate with a second luminance lower than the first luminance to darken the brightness of the display 210 when the measured illuminance goes down to $DH_1$ or less and may operate with a third luminance higher than the first luminance to brighten the brightness of the display 210 when the measured illuminance goes up to or more. Hysteresis operation criterion is the average value at that time or the first illuminance value (or data value) after the corresponding illuminance value (e.g. down hysteresis or up hysteresis) for a specified n seconds (e.g., about 2 seconds). It can be changed to the corresponding luminance based on it.

The illuminance sensor 500 may have a certain element capable of measuring (or detecting) ambient light (or the amount of light) so as to estimate the brightness (or illuminance) around the electronic device 101. For example, the illuminance sensor 500 may include a specific element (e.g., a cadmium sulfide (CdS) element) producing a photoelectric effect that electrons move upon receiving light and thereby conductivity is changed. The illuminance sensor 500 may measure the intensity of ambient light in a manner similar to the human eye in various lighting conditions or environments. In the illuminance sensor 500, the conductivity changes depending on the amount of light. That is, as the amount of light increases, the conductivity increases and the resistance decreases. For example, the resistance may be about 10 kΩ in a slightly dark environment (e.g., in a theater, about 10 lux), and the resistance may be about 200 kΩ in a very dark environment (e.g., a darkroom, about 0 lux to about 2 lux). The illuminance sensor 500 may be combined with a proximity sensor and may be implemented as one of various sensors, which operate (or sense) based on light, such as a picker sensor, a flicker sensor, a color sensor, and/or a spectrometer.

The illuminance sensor 500 may be disposed in the inactive area of the display 210 or the active area of the display 210. When disposed in the inactive area, the illuminance sensor 500 may measure ambient light and, based on this, provide an illuminance value for adjusting the brightness of the display 210, When disposed in the active area, the illuminance sensor 500 may measure ambient light at a display-off time of the display 210 and, based on this, provide an illuminance value for adjusting the brightness of the display 210. The electronic device 101 may correct the measured illuminance value by using COPR information. As such, the illuminance sensor may measure an illuminance value only at the display-off time to minimize the influence from the display 210, and also the measured illuminance value may be corrected based on a color displayed on the display 210.

The processor 120 may identify the illuminance around the electronic device 101, based on sensor data acquired from the illuminance sensor 500, and control the operation of the display 210 (e.g., setting the luminance of the display 210), based on the identified illuminance. For example, the processor 120 may read an illuminance value from the illuminance sensor 500, select a display luminance value corresponding to the illuminance value from the platform code table as shown in Table 1, and provide the luminance value to the display 210 (e.g., the DDI 230 in FIG. 2), The processor 120 may control the display 210 to operate with a specific brightness corresponding to the luminance based on the manual or automatic brightness adjustment. The processor 120 may adjust the luminance of the display 210, based on the platform code table as shown in Table 1.

The processor 120 may increase the accuracy of illuminance sensing by controlling the integration time of the illuminance sensor 500 based on a plurality of threshold illuminance values corresponding to the platform codes (or brightness levels) of the display 210. The processor 120 may control (e.g., luminance control) the operation of the display 210 to be suitable for ambient light, based on the threshold illuminance value which may vary. When a flag is set under a specific condition, the processor 120 may update the threshold illuminance value accordingly and change a target luminance of the display 210 based on the updated threshold illuminance value.

The processor 120 may change (or update) the threshold illuminance value to allow a measured illuminance value more suitable for ambient light to be provided. For example, when the processor 120 identifies a predetermined (or initially set) threshold illuminance value through monitoring using the illuminance sensor 500 (e.g., when the measured illuminance value is a threshold illuminance value), the processor 120 may set a specific flag and identify (or calculate) a final threshold illuminance value while gradually changing threshold illuminance values. The processor 120 may set the luminance of the display 210, based on the identified final threshold illuminance value, thereby setting the brightness of the display 2:1.0 as more optimized luminance for the ambient light. As such, the electronic device 101 may provide the user with the brightness of the display 210 that is optimized for a change to a dark environment. Embodiments of adjusting the brightness of the display 210 using the illuminance sensor 500 will be described later.

The processor 120 may include an illuminance identifying manager 510 and a luminance setting manager 520. For example, the illuminance identifying manager 510 and the luminance setting manager 520 may perform distributed processing on operations of the processor 120.

The illuminance identifying manager 510 may perform various calculations using a measured value of light acquired from the illuminance sensor 500, may extract the measured value (e.g., sensor data) provided from the illuminance sensor 500 and, based on the extracted measured value, predict (or estimate) the illuminance (or brightness level) around the electronic device 101, and may provide a predicted (or estimated) illuminance value to the luminance setting manager 520.

The illuminance identifying manager 510 may continuously monitor the predicted value and identify whether the predicted value corresponds to a predetermined (or initially set) threshold illuminance value (min lux). When identifying the threshold illuminance value, the illuminance identifying manager 510 may provide the threshold illuminance value instead of the measured illuminance value to the luminance setting manager 520. For example, when the measured illuminance value indicates the threshold illuminance value, the illuminance identifying manager 510 may update the threshold illuminance value to decrease the luminance of the display 210 and provide the updated threshold illuminance value to the luminance setting manager 520.

The illuminance identifying manager 510 may identify the threshold illuminance value, based on the platform code of the display 210, and set a specific flag upon identifying the threshold illuminance value, in an embodiment, the illuminance identifying manager 510 may identify a final threshold illuminance value while sequentially (or stepwise) changing predetermined threshold illuminance value, based on the flag. For example, the illuminance identifying manager 510 may change (or update) the predetermined threshold illuminance value to provide a more suitable illuminance value for a surrounding environment to the luminance setting manager 520.

The luminance setting manager 520 may extract the illuminance value provided by the illuminance identifying manager 510 and, based on the extracted predicted value, determine the luminance of the display 210. The luminance setting manager 520 may adjust the luminance of the display 210, based on the measured illuminance value or the threshold illuminance value provided by the illuminance identifying manager 510, thereby controlling the brightness of the display 210.

The processor 120 may update the threshold illuminance value during an operation of controlling the luminance of the display 210 (e.g., during an operation of lowering the luminance). While adjusting the luminance of the display 2:1.0, the processor 120 may control the integration time, based on the platform code and/or the threshold illuminance value as shown in Table 2 below, thereby improving the accuracy of illuminance sensing of the illuminance sensor 500, Table 2 shows a mapping table that indicates the relationship among a platform code, an illuminance measurement time (i.e., integration time), and a threshold illuminance value. The processor 120 may store platform codes each corresponding to the luminance of the display 210 and the threshold illuminance value in the memory 130 in the form of a table.

The illuminance sensor 500 may measure the illuminance for a specific time (e.g., about regardless of the brightness of the display 210, wherein the specific time refers to the total measurement time for illuminance sensing. For example, assuming that one measurement cycle of the illuminance sensor 500 is about 20 ms, the illuminance sensor 500 is capable of measuring approximately one hundred (i.e., 2 sec/20 ms=100) samples (e.g., sensor data) for the total measurement time (i.e., 2 sec). In addition, assuming that the integration time of the illuminance sensor 500 is about 2 ms, the illuminance sensor 500 may measure the illuminance for about 200 ms (i.e., 2 ms*100=200 ms). Assuming that the integration time of the illuminance sensor 500 is about 500 us, the illuminance sensor 500 may measure the illuminance for about 50 ms (i.e., 500 us*1.00=50 ms). In order to immediately change the brightness of the display 210 after measuring the illuminance at the illuminance sensor 500 when the electronic device 101 moves between a bright location and a dark location, the total measurement time may be constant for usability.

TABLE 2

| Platform Code (code) | Measurement Time (integration time) | Threshold Illuminance (min lux) | Hysteresis |
|---|---|---|---|
| 1-50 | $T_1$ (e.g., about 2 ms) | $ML_1$ (e.g., about 2 lux) | $H_{D1} < ML_1 < H_{U1}$ |
| 51-100 | $T_2$ (e.g., about 1.5 ms) | $ML_2$ (e.g., about 4 lux) | $H_{D2} < ML_2 < H_{U2}$ |
| 101-150 | $T_3$ (e.g., about 1 ms) | $ML_3$ (e.g., about 6 lux) | $H_{D3} < ML_3 < H_{U3}$ |
| 151-200 | $T_4$ (e.g., about 800 us) | $ML_4$ (e.g., about 8 lux) | $H_{D4} < ML_4 < H_{U4}$ |
| 201-255 | $T_5$ (e.g., about 500 us) | $ML_5$ (e.g., about 10 lux) | $H_{D5} < ML_5 < H_{U5}$ |

As shown in Table 2, the platform code may be divided into a plurality of groups (e.g., 5 groups) each having a certain range, and both the integration time and the threshold illuminance value may be set for each group. In Table 2, the platform code is divided into 5 groups (i.e., Group 1 to Group 5). For a first group platforms 1 to 50), a first integration time $T_1$ (e.g., about 2 ms) and a first threshold illuminance value $ML_1$ (e.g., about 2 lux) are set. For a second group (e.g., platforms 51 to 100), a second integration time $T_2$ (e.g., about 1.5 ins) and a second threshold illuminance value $ML_2$ (e.g., about 4 lux) are set. For a third group (e.g., platforms 101 to 150), a third integration time $T_3$ (e.g., about 1 ms) and a third threshold illuminance value $ML_3$ (e.g., about 6 lux) are set. For a fourth group (e.g., platforms 151 to 200), a fourth integration time $T_4$ (e.g., about 800 microseconds (us)) and a fourth threshold illuminance value $ML_4$ (e.g., about 8 lux) are set. For a fifth group (e.g., platforms 201 to 255), a fifth integration time $T_5$ (e.g., about 500 us) and a fifth threshold illuminance value $ML_5$ (e.g., about 10 lux) are set. Table 2 is only an example and is not to be considered as a limitation. Groups of platform codes and corresponding integration times and threshold illuminance values may be variously set.

As shown in Table 2, the integration time of the illuminance sensor 500 may be changed depending on the brightness (e.g., luminance or platform code) of the display 210. That is, the brighter the display 210 and the higher the platform code, the shorter the integration time, and the darker the display 210 and the lower the platform code, the longer the integration time. Because the total measurement time of the illuminance sensor 500 is constant as described above, the measurement time experienced by the user may also be constant. However, an actual measurement time of the illuminance sensor 500 may vary due to a difference in the display-off time or zone. In particular, the display 210 may operate based on the basic platform code table as shown in Table 1 in a normal measurement environment and operate based on the mapping table as shown in Table 2 in specific operating conditions, such as when the illuminance sensor 500 fails to measure the illuminance as moving to a dark environment.

As shown in Table 2, the hysteresis may be set based on the threshold illuminance value of each group. For example, a first hysteresis ($H_{D1}<ML_1<H_{U1}$) may be set based on the first threshold illuminance value $ML_1$ of the first group platforms 1 to 50). In addition, a second hysteresis ($H_{D2}<ML_2<H_{U2}$) may be set based on the second threshold illuminance value $ML_2$ of the second group (e.g., platforms 51 to 100), and a third hysteresis ($H_{D3}<ML_3<H_{U3}$) may be set based on the third threshold illuminance value $ML_3$ of the third group (e.g., platforms 101 to 150). Also, a fourth hysteresis ($H_{D4}<ML_4<H_{U4}$) may be set based on the fourth threshold illuminance value $ML_4$ of the fourth group (e.g., platforms 151 to 200), and a fifth hysteresis ($H_{D5}<ML_5<$Hus) may be set based on the fifth threshold illuminance value $ML_5$ of the fifth group (e.g., platforms 201 to 255). As such, based on the threshold illuminance value for each group, corresponding down hysteresis and up hysteresis may be set. According to an embodiment, assuming that the threshold illuminance values, $ML_1$ to $ML_5$, of the first to fifth groups are as shown in Table 2, the first hysteresis to the fifth hysteresis may be set as shown in Table 3 below.

TABLE 3

| Hysteresis | Range |
|---|---|
| 1st Hysteresis | 0 lux (DH) < 2 lux < 24 lux (UH) |
| 2nd Hysteresis | 0 lux (DH) < 4 lux < 38 lux (UH) |
| 3rd Hysteresis | 1 lux (DH) < 6 lux < 51 lux (UH) |
| 4th Hysteresis | 2 lux (DH) < 8 lux < 63 lux (UH) |
| 5th Hysteresis | 5 lux (DH) < 10 lux < 100 lux (UH) |

The hysteresis range shown in Table 3 is only an example and may be variously set depending on the design of the electronic device 101. Also, the hysteresis range may follow hysteresis for each illumination defined in the platform code table as shown in Table 1. The illuminance sensor 500 may fail to identify light at a certain illuminance or less (e.g., about 5 lux) and fail to output a sensor value. Therefore, as shown in Table 3, the DH of the first hysteresis and the DH of the second hysteresis may have the same value (e.g., about 0 lux) related to the threshold illuminance value of a specific illuminance or less (e.g., about 5 lux). For example, the DH may indicate a lower limit for detecting a decrease in brightness of the illuminance sensor 500.

Figure 6:
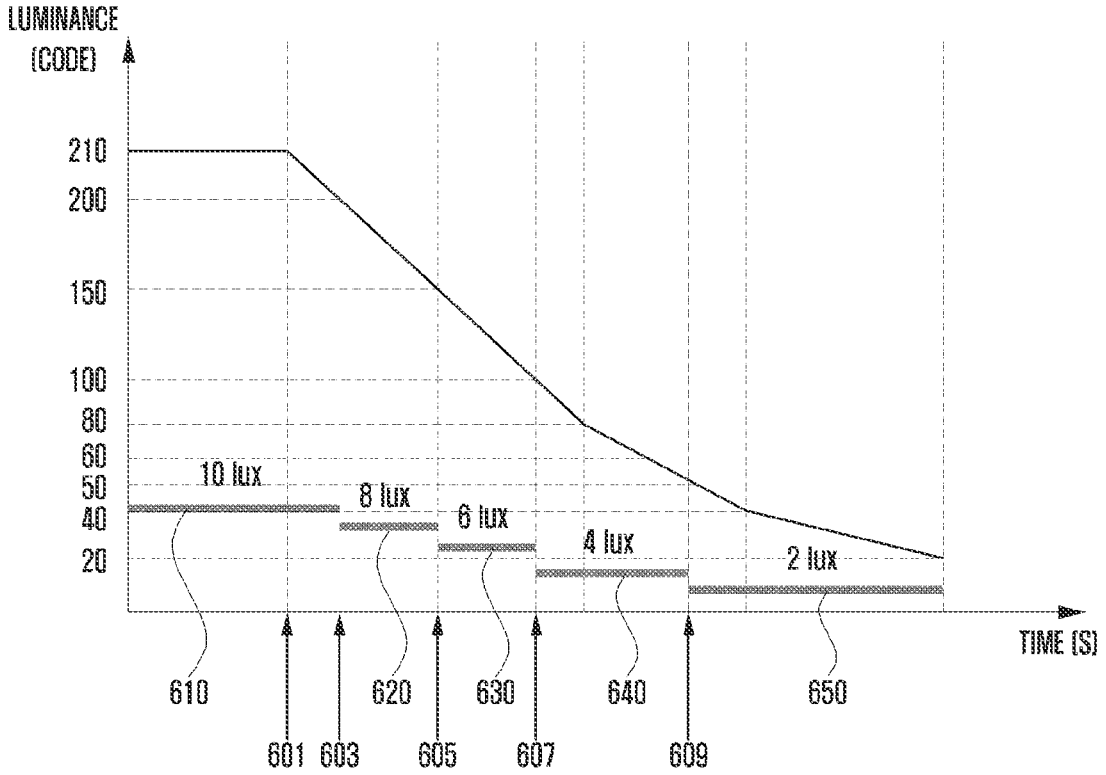
FIG. 6 illustrates an example of changing the luminance of a display in an electronic device according to an embodiment.

FIG. 6 illustrates an example of changing the luminance of a display in an electronic device according to an embodiment.

In FIG. 6, a user moves from a first place (e.g., a bright environment with an illuminance of about 50 lux) to a second place (e.g., a darkroom environment with an illuminance of about 0 lux). In the first place, the luminance of the display 210 may be set to a certain luminance value (e.g., corresponding to the code 210) corresponding to ambient light (e.g., current illuminance of about 50 lux). In FIG. 6, the user moves to a dark location such as a darkroom where illuminance measurement is impossible.

Assuming that the luminance of the display 210 corresponds to the code 210, the illuminance sensor 500 may operate to measure the illuminance for a short integration time such as the first integration time (e.g., $T_5$ of about 500 us in Table 2), In this case, when the illuminance rapidly decreases as the user moves from a bright location to a dark location such as a room of about 0 lux to about 2 lux, the illuminance sensor 500 may be difficult to detect sufficient illuminance. When disposed on the under panel, the illuminance sensor 500 may measure a lower illuminance than the actual illuminance because of failing to detect sufficient light due to the characteristics of a mounting structure. If the luminance of the display 210 is adjusted based on the illuminance value measured by the illuminance sensor 500 in such an environment, the illuminance sensor 500 may fail to measure sufficient illuminance, and thus the brightness of the display 210 may be too darker than the ambient brightness. In order to prevent this problem, a threshold illuminance value (i.e., min lux) may be set for the luminance (or platform code) of the display 210. For example, when the display 210 is operating with high brightness (e.g., a luminance of code 210 or more) and no illumination is measured (e.g., in a very dark location such as a darkroom), the processor 120 may control the illuminance sensor 500 to output the initial threshold illuminance value $ML_5$ (e.g., about 10 lux).

Referring to FIG. 6, when the illuminance sensor 500 detects a change in illuminance as described above, the processor 120 may acquire a measured illuminance value for n seconds (e.g., about 2 seconds) from the illuminance sensor 500. When the measured illuminance value of the illuminance sensor 500 maintains the threshold illuminance value $ML_5$ (e.g., about 10 lux) as indicated by 610, the processor 120 may set, as a target luminance, a luminance (e.g., code 80) corresponding to $ML_5$ (e.g., about 10 lux) which is an initial illuminance value (or average value) after n seconds as indicated by 601. For example, in an environment such as a darkroom, the illuminance sensor 500 may not output an illuminance value or may output an actually measured illuminance value (e.g., about 0 lux to about 2 lux). When the processor 120 acquires an illuminance value less than the threshold illuminance value from the illuminance sensor 500 that operates based on the threshold illuminance value (e.g., $ML_5$), the processor 120 may disregard the acquired value and identify the threshold illuminance value as an illuminance value applied to the illuminance sensor 500, In order to change the luminance of the display 210 in accordance with the identified threshold illuminance value (e.g., about 10 lux), the processor 120 may set the target luminance to a luminance (e.g., code 80) corresponding to the threshold illuminance value (e.g., about 10 lux), Then, the processor 120 may control the brightness of the display 210 so that the luminance of the display 210 reaches the target luminance (code 80) from the current luminance (code 210).

While the processor 120 controls the brightness of the display 210 based on the updated target luminance (e.g., code 80), the luminance of the display 210 may be decreased from the current group (e.g., the fifth group) to the next group (e.g., the fourth group) as indicated by 603. That is, the luminance of the display 210 may decrease less than or equal to the maximum luminance (e.g., code 200) of the next group (e.g., the fourth group). In this case, the processor 120 may set a flag for updating the threshold illuminance value. In addition, through the flag, the processor 120 may change (or update) the threshold illuminance value of the illuminance sensor 500 to MIA (e.g., about 8 lux) which is the threshold illuminance value of a new group (e.g., the fourth group).

Based on the update of the threshold illuminance value, the processor 120 may increase the integration time of the illuminance sensor 500 to the second integration time (e.g., $T_4$ of about 800 us in Table 2) of the fourth group. Then, the processor 120 may acquire a measured illuminance value for n seconds from the illuminance sensor 500, based on the update of the threshold illuminance value (or based on a setting value of the flag). When the measured illuminance value of the illuminance sensor 500 maintains the updated threshold illuminance value $ML_4$ (e.g., about 8 lux) as indicated by 620, the processor 120 may set, as the target luminance, a luminance (e.g., code 60) corresponding to $ML_4$ (e.g., about 8 lux) which is an initial illuminance value (or average value) after n seconds. For example, the electronic device 101 may still exist in an environment such as a darkroom, and the illuminance sensor 500 may not output an illuminance value or may output an actually measured illuminance value (e.g., about 0 lux to about 2 lux). When the processor 120 acquires an illuminance value less than the threshold illuminance value from the illuminance sensor 500 that operates based on the threshold illuminance value (e.g., $ML_4$), the processor 120 may disregard the acquired value and identify the threshold illuminance value as applied to the illuminance sensor 500. In order to change the luminance of the display 210 in accordance with the identified threshold illuminance value (e.g., about 8 lux), the processor 120 may update the target luminance to a luminance (e.g., code 60) corresponding to the threshold illuminance value (e.g., about 8 lux). Then, the processor 120 may control the brightness of the display 210 so that the luminance of the display 210 reaches the updated target luminance (code 60) from the current luminance (code 80).

While the processor 120 controls the brightness of the display 210 based on the updated target luminance (e.g., code 60), the luminance of the display 210 may be decreased from the current group (e.g., the fourth group) to the next group (e.g., the third group) as indicated by 605. That is, the luminance of the display 210 may decrease less than or equal to the maximum luminance (e.g., code 150) of the next group (e.g., the third group), In this case, the processor 120 may set a flag for updating the threshold illuminance value. In addition, through the flag, the processor 120 may change (or update) the threshold illuminance value of the illuminance sensor 500 to $ML_3$ (e.g., about 6 lux) which is the threshold illuminance value of a new group (e.g., the third group).

Based on the update of the threshold illuminance value, the processor 120 may increase the integration time of the illuminance sensor 500 to the third integration time (e.g., $T_3$ of about 1 ms in Table 2) of the third group. Then, the processor 120 may acquire a measured illuminance value for n seconds from the illuminance sensor 500, based on the update of the threshold illuminance value (or based on a setting value of the flag). When the measured illuminance value of the illuminance sensor 500 maintains the updated threshold illuminance value $ML_3$ (e.g., about 6 lux) as indicated by 630, the processor 120 may set, as the target luminance, a luminance (e.g., code 50) corresponding to $ML_3$ (e.g., about 6 lux) which is an initial illuminance value (or average value) after n seconds. For example, the illuminance sensor 500 may not still output an illuminance value or may Output an actually measured illuminance value (e.g., about 0 lux to about 2 lux) in a similar or same environment (e.g., darkroom environment). When the processor 120 acquires an illuminance value smaller than the threshold illuminance value from the illuminance sensor 500 that operates based on the threshold illuminance value (e.g., MLA the processor 120 may disregard the acquired value and identify the threshold illuminance value as an illuminance value applied to the illuminance sensor 500. In order to change the luminance of the display 210 in accordance with the identified threshold illuminance value (e.g., about 6 lux), the processor 120 may update the target luminance to a luminance (e.g., code 50) corresponding to the threshold illuminance value (e.g., about 6 lux). Then, the processor 120 may control the brightness of the display 210 so that the luminance of the display 210 reaches the updated target luminance (code 50) from the current luminance (code 60).

While the processor 120 controls the brightness of the display 210 based on the updated target luminance (e.g., code 50), the luminance of the display 210 may be decreased from the third group to the second group as indicated by 607. That is, the luminance of the display 211) may decrease less than or equal to the maximum luminance (e.g., code 100) of the next group (e.g., the second group). In this case, the processor 120 may set a flag for updating the threshold illuminance value. In addition, through the flag, the processor 120 may change (or update) the threshold illuminance value of the illuminance sensor 500 to (e.g., about 4 lux) which is the threshold illuminance value of a new group (e.g., the second group).

Based on the update of the threshold illuminance value, the processor 120 may set (or increase) the integration time of the illuminance sensor 500 to the second integration time $T_2$ of about 1.5 ins in Table 2) of the second group. Then, the processor 120 may acquire a measured illuminance value for n seconds from the illuminance sensor 500, based on the update of the threshold illuminance value (or based on a setting value of the flag). When the measured illuminance value of the illuminance sensor 500 maintains the updated threshold illuminance value $ML_2$ (e.g., about 4 lux) as indicated by 640, the processor 120 may set, as the target luminance, a luminance (e.g., code 40) corresponding to $ML_2$ (e.g., about 4 lux) which is an initial illuminance value (or average value) after n seconds. For example, the illuminance sensor 500 may not still output an illuminance value or may output an actually measured illuminance value (e.g., about 0 lux to about 2 lux) in a similar or same dark environment. When the processor 120 acquires an illuminance value less than the threshold illuminance value from the illuminance sensor 500 that operates based on the threshold illuminance value (e.g., WA the processor 120 may disregard the acquired value and identify the threshold illuminance value as an illuminance value applied to the illuminance sensor 500, In order to change the luminance of the display 210 in accordance with the identified threshold illuminance value (e.g., about 4 lux), the processor 120 may set update) the target luminance to a luminance (e.g., code 40) corresponding to the threshold illuminance value (e.g., about 4 lux). Then, the processor 120 may control the brightness of the display 210 so that the luminance of the display 210 reaches the updated target luminance (code 40) from the current luminance (code 50).

While the processor 120 controls the brightness of the display 210 based on the updated target luminance (e.g., code 40), the luminance of the display 210 may be decreased from the second group to the first group as indicated by 609. That is, the luminance of the display 210 may decrease less than or equal to the maximum luminance (e.g., code 50) of the next group (e.g., the first group), In this case, the processor 120 may set a flag for updating the threshold illuminance value. In addition, through the flag, the processor 120 may change (or update) the threshold illuminance value of the illuminance sensor 500 to $ML_1$ (e.g., about 2 lux) which is the threshold illuminance value of a new group (e.g., the first group).

Based on the update of the threshold illuminance value, the processor 120 may increase the integration time of the illuminance sensor 500 to the first integration time (e.g., $T_1$ of about 2 ms in Table 2) of the first group. As the integration time of the illuminance sensor 500 increases, the accuracy (e.g., sensitivity in low illuminance) of illuminance sensing by the illuminance sensor 500 may also increase. Then, the processor 120 may acquire a measured illuminance value for n seconds from the illuminance sensor 500, based on the update of the threshold illuminance value (or based on a setting value of the flag).

When the measured illuminance value of the illuminance sensor 500 maintains the updated threshold illuminance value $ML_1$ (e.g., about 2 lux) as indicated by 650, the processor 120 may set, as the target luminance, a luminance (e.g., code 20) corresponding to $ML_1$ (e.g., about 2 lux) which is an initial illuminance value (or average value) after n seconds. For example, the illuminance sensor 500 still may not output an illuminance value or may Output an actually measured illuminance value (e.g., about 0 lux to about 2 lux) in a similar or same dark environment.

When the processor 120 acquires an illuminance value less than the threshold illuminance value from the illuminance sensor 500 that operates based on the threshold illuminance value (e.g., $ML_1$), the processor 120 may disregard the acquired value and identify the threshold illuminance value as an illuminance value applied to the illuminance sensor 500, In order to change the luminance of the display 210 in accordance with the identified threshold illuminance value (e.g., about 2 lux), the processor 120 may update the target luminance to a luminance (e.g., code 20) corresponding to the threshold illuminance value (e.g., about 2 lux). Then, the processor 120 may control the brightness of the display 210 so that the luminance of the display 210 reaches the updated target luminance (code 20) from the current luminance (code 40).

When the brightness of the display 210 decreases less than or equal to the maximum luminance (e.g., code 50) of the first group, the processor 120 may determine the threshold illuminance value $ML_1$ (e.g., about 2 lux) as the final threshold illuminance value and also determine the luminance (e.g., code 20) corresponding to the final threshold illuminance value $ML_1$ (e.g., about 2 lux) as the final target luminance. In addition, when the last operation of the first group is performed, there may be no threshold illuminance value to be decreased any more. That is, all measured illuminances after the threshold illuminance value of about 2 lux may fall in the first hysteresis range, and the corresponding threshold illuminance value $ML_1$ (e.g., about 2 lux) and the corresponding target luminance (e.g., about code 20) may be the final threshold illuminance value and the target luminance, respectively. When the flag setting related to the threshold illuminance value is no longer changed during the operation as described above, the processor 120 may set a predetermined luminance as the final target luminance of the display 210 and terminate a process of adjusting the luminance of the display 210. As such, embodiments relate to controlling the threshold illuminance value through a flag, controlling the integration time based on variations of the threshold illuminance value, and setting the final luminance of the display 210 to be controlled, based on the luminance corresponding to the threshold illuminance value, FIG. 7 illustrates another example of changing the luminance of a display in an electronic device according to an embodiment.

Figure 7:
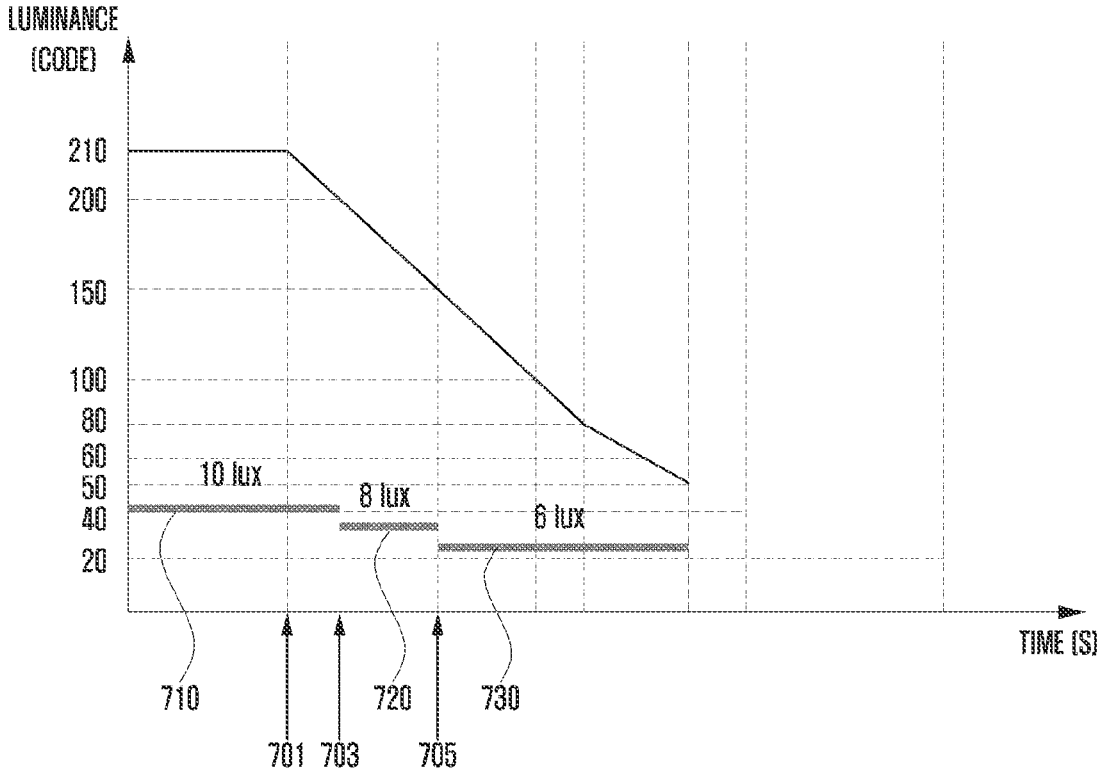
FIG. 7 illustrates another example of changing the luminance of a display in an electronic device according to an embodiment.

FIG. 7 shows an example in which a user moves from a first place (e.g., a bright environment with an illuminance of about 50 lux) to a second place (e.g., a slightly dark environment with an illuminance of about 7 lux). The luminance of the display 210 may be initially set to a certain luminance value (e.g., corresponding to the code 210) corresponding to ambient light (e.g., current illuminance of about 50 lux). In FIG. 7, the user moves to a slightly dark location where illuminance measurement is possible.

Assuming that the luminance of the display 210 corresponds to the code 210, the illuminance sensor 500 may operate to measure the illuminance for a short integration time such as the first integration time (e.g., $T_5$ of about 500 us in Table 2). In this case, when the illuminance rapidly decreases as the user moves from a bright location to a slightly dark location, the illuminance sensor 500 may be difficult to detect sufficient illuminance. When disposed on the under panel, the illuminance sensor 500 may measure a lower illuminance than the actual illuminance due to failing to detect sufficient light due to the characteristics of a mounting structure. If the luminance of the display 210 is adjusted based on the illuminance value measured by the illuminance sensor 500 in such an environment, the illuminance sensor 500 may fail to measure sufficient illuminance, and thus the brightness of the display 210 may be too dark when compared to the ambient brightness. In order to prevent this problem, a threshold illuminance value (i.e., min lux) may be set for the luminance (or platform code) of the display 210, For example, when the display 2:1.0 is operating with high brightness (e.g., a luminance of code 210 or more) and low illumination is measured (e.g., in a third place), the processor 120 may control the illuminance sensor 500 to output the initial threshold illuminance value $ML_5$ (e.g., about 10 lux).

Referring again to FIG. 6, when the illuminance sensor 500 detects a change in illuminance as described above, the processor 120 may acquire a measured illuminance value for n seconds (e.g., about 2 seconds) from the illuminance sensor 500. When the measured illuminance value of the illuminance sensor 500 maintains the threshold illuminance value $ML_5$ (e.g., about 10 lux) as indicated by 710, the processor 120 may set, as a target luminance, a luminance (e.g., code 80) corresponding to $ML_5$ about 10 lux) which is an initial illuminance value (or average value) after n seconds as indicated by 701. For example, the illuminance sensor 500 may output a measured illuminance value (e.g., about 7 lux). When the processor 120 acquires an illuminance value smaller than the threshold illuminance value from the illuminance sensor 500 that operates based on the threshold illuminance value (e.g., $ML_5$), the processor 120 may disregard the acquired value and identify the threshold illuminance value as an illuminance value applied to the illuminance sensor 500. In order to change the luminance of the display 210 in accordance with the identified threshold illuminance value (e.g., about 10 lux), the processor 120 may set the target luminance to a luminance (e.g., code 80) corresponding to the threshold illuminance value (e.g., about 10 lux), Then, the processor 120 may control the brightness of the display 210 so that the luminance of the display 210 reaches the target luminance (code 80) from the current luminance (code 210).

While the processor 120 controls the brightness of the display 210 based on the updated target luminance (e.g., code 80), the luminance of the display 210 may be decreased from the current group (e.g., the fifth group) to the next group (e.g., the fourth group) as indicated by 703. That is, the luminance of the display 210 may decrease less than or equal to the maximum luminance (e.g., code 200) of the next group (e.g., the fourth group). In this case, the processor 120 may set a flag for updating the threshold illuminance value. In addition, through the flag, the processor 120 may change (or update) the threshold illuminance value of the illuminance sensor 500 to $ML_4$ (e.g., about 8 lux) which is the threshold illuminance value of a new group (e.g., the fourth group).

Based on the update of the threshold illuminance value, the processor 120 may set (or increase) the integration time of the illuminance sensor 500 to the second integration time (e.g., $T_4$ of about 800 us in Table 2) of the fourth group.

Then, the processor 120 may acquire a measured illuminance value for n seconds from the illuminance sensor 500, based on the update of the threshold illuminance value (or based on a setting value of the flag). When the measured illuminance value of the illuminance sensor 500 maintains the updated threshold illuminance value $ML_4$ (e.g., about 8 lux) as indicated by 720, the processor 120 may set, as the target luminance, a luminance (e.g., code 60) corresponding to $ML_4$ (e.g., about 8 lux) which is an initial illuminance value (or average value) after n seconds. For example, the electronic device 101 may still exist in a similar or same environment, and the illuminance sensor 500 may output the measured illuminance value (e.g., about 7 lux).

When the processor 120 acquires an illuminance value less than the threshold illuminance value from the illuminance sensor 500 that operates based on the threshold illuminance value (e.g., $ML_4$), the processor 120 may disregard the acquired value and identify the threshold illuminance value as an illuminance value applied to the illuminance sensor 500. In order to change the luminance of the display 210 in accordance with the identified threshold illuminance value (e.g., about 8 lux), the processor 120 may set (e.g., update) the target luminance to a luminance (e.g., code 60) corresponding to the threshold illuminance value (e.g., about 8 lux). Then, the processor 120 may control the brightness of the display 210 so that the luminance of the display 210 reaches the updated target luminance (code 60) from the current luminance (code 80).

While the processor 120 controls the brightness of the display 210 based on the updated target luminance (e.g., code 60), the luminance of the display 210 may be decreased from the current group (e.g., the fourth group) to the next group (e.g., the third group) as indicated by 705. That is, the luminance of the display 210 may decrease less than or equal to the maximum luminance (e.g., code 150) of the next group (e.g., the third group). In this case, the processor 120 may set a flag for updating the threshold illuminance value. In addition, through the flag, the processor 120 may update the threshold illuminance value of the illuminance sensor 500 to $ML_3$ (e.g., about 6 lux) which is the threshold illuminance value of a new group (e.g., the third group).

Based on the update of the threshold illuminance value, the processor 120 may set (or increase) the integration time of the illuminance sensor 500 to the third integration time (e.g., $T_3$ of about 1 iris in Table 2) of the third group. Then, the processor 120 may acquire a measured illuminance value for n seconds from the illuminance sensor 500, based on the update of the threshold illuminance value (or based on a setting value of the flag). The processor 120 may acquire a measured illuminance value greater than or equal to the updated threshold illuminance value $ML_3$ (e.g., about 6 lux) from the illuminance sensor 500 as indicated by 730.

When the processor 120 acquires an illuminance value greater than or equal to the threshold illuminance value from the illuminance sensor 500 that operates based on the threshold illuminance value (e.g., $ML_3$), the processor 120 may determine the threshold illuminance value $ML_3$ (e.g., about 6 lux) or the measured illuminance value (e.g., about 7 lux) as the final threshold illuminance value and also determine the luminance (e.g., code 50) corresponding to the final threshold illuminance value $ML_3$ (e.g., about 6 lux) or the measured illuminance value (e.g., about 7 lux) as the final target luminance. For example, when an illuminance value greater than or equal to the threshold illuminance value is measured, and if the luminance of the display 210 is decreased less than or equal to the maximum luminance, the brightness of the display 210 may be darker than the ambient light. In case of a measurement illuminance greater than or equal to the threshold illuminance value, the corresponding threshold illuminance value $ML_3$ (e.g., about 6 lux) or the measured illuminance value (e.g., about 7 lux) and the corresponding target luminance (e.g., about code 50) may be the final threshold illuminance value and the target luminance, respectively. The flag setting related to the threshold illuminance value may be no longer changed during the operation as described above, so that the processor 120 may set a predetermined luminance as the final target luminance of the display 210 and terminate a process of adjusting the luminance of the display 210. As such, embodiments relate to controlling the threshold illuminance value through a flag, controlling the integration time based on variations of the threshold illuminance value, and setting the final luminance of the display 210 to be controlled, based on the luminance corresponding to the threshold illuminance value.

In FIG. 6, when the electronic device 101 moves from a 50 lux environment to a darkroom (e.g., about 0 lux to about 2 lux), the processor 120 may control the luminance of the display 210 based on a change (or update) up to the threshold illuminance value of the last stage (e.g. $ML_4$). In FIG. 7, when the electronic device 101 moves from a 50 lux environment to an environment of a certain illuminance or more (e.g., M lux, which includes 5 lux or more and below the initial threshold illuminance value such as about 10 lux), the processor 120 may determine the final luminance of the display 210 based on the threshold illuminance value of an intermediate stage (e.g., $ML_2$, $ML_3$, $ML_4$, or $ML_5$) corresponding to a certain illuminance.

When the electronic device 101 moves from a dark location to a bright location, the above-described operation based on the threshold illuminance value may not be performed. When the electronic device 101 moves from a bright location to a dark location, the electronic device 101 may perform the above-described operation based on the threshold illuminance value (e.g., updating the threshold illuminance value) to reach step by step the final luminance value suitable for the user's environment, thereby providing a smooth and natural brightness control effect to the user and prevent the user from glare. For example, when the user moves from a bright location to a dark location, the luminance of the display 210 becomes less dark, thereby solving the user's dazzling discomfort and providing the user with a comfortable screen with a luminance more suitable for ambient light.

The electronic device 101 may update the threshold illuminance value during an operation (e.g., a luminance control operation) in which the luminance of the display 210 decreases and may control the integration time based on the updated threshold illuminance value. When the initial target luminance (e.g., code 80) is reached based on the initial threshold illuminance value, the target luminance may be reset based on the illuminance value measured by the illuminance sensor 500 at that time point. That is, the electronic device 101 may operate in a manner that resets the second target luminance after reaching the first target luminance instead of during a decrease in luminance.

As described above, the electronic device 101 may limit the existing operation based on the threshold illuminance value (e.g., min lux) in consideration of the integration time of the illuminance sensor 500 and the luminance of the display 210. A plurality of threshold illuminance values may be provided to have different values and also set for each luminance group (e.g., platform code) having a certain range, and the operation based on the threshold illuminance value suitable for the corresponding luminance may be performed.

When the threshold illuminance value is updated while the luminance of the display 210 is changed, the electronic device 101 may set flag information and also set the luminance value corresponding to the threshold illuminance value as the final luminance of the display 210. When a luminance change of the display 210 is completed, the electronic device 101 may check the flag for a certain time and thereby change stepwise the luminance of the display 210 to naturally correspond to the ambient light. According to an embodiment, when the threshold illuminance value is updated, the luminance of the display 210 may be changed to the final luminance with an increase in changing time.

The electronic device 101 may consider a possibility that a low illuminance value is outputted due to the sensitivity of the illuminance sensor 500 in a low-illuminance environment. That is, when the raw data of the illuminance value is low, the electronic device 100 may enable the illuminance sensor 500 to output the illuminance value similar to the ambient environment by using the average or maximum value of values measured for a certain time. In order to improve the sensitivity of an algorithm for reading the threshold illuminance value, the electronic device 101 may output the illuminance value using the average value and/or the maximum value instead of the threshold illuminance value in low illuminance.

As described above, an electronic device may include a display, an illuminance sensor, and a processor operatively connected to the display and the illuminance sensor. The processor may be configured to set a wake-up luminance of the display, based on a wake-up illuminance, to set, upon detecting an illuminance change through the illuminance sensor, a first target luminance of the display by using a first threshold illuminance value at a time point of detecting the illuminance change, to identify whether a flag setting related to an update of a threshold illuminance value is changed, while changing a luminance of the display based on the first target luminance, to determine the first target luminance as a final luminance of the display when there is no change in the flag setting, to update the first threshold illuminance value to a second threshold illuminance value when there is a change in the flag setting, and to change a target luminance of the display from the first target luminance to a second target luminance by using the second threshold illuminance value.

The processor may be further configured to identify, as the wake-up illuminance, an illuminance value measured by the illuminance sensor immediately before the display is turned on, based on detecting a wake-up of the display, to set an initial range of the wake-up luminance of the display, based on the wake-up illuminance, and to control the display to be turned on with brightness corresponding to the wake-up luminance. The initial range may include hysteresis depending on the wake-up illuminance.

The processor may be further configured to monitor the hysteresis based on the illuminance change, to identify whether a measured illuminance value of the illuminance sensor according to the illuminance change exceeds the hysteresis, and to use the first threshold illuminance value instead of the measured illuminance value of the illuminance sensor when the measured illuminance value exceeds the hysteresis for a predetermined time.

The hysteresis may include down hysteresis and up hysteresis which are set based on the wake-up illuminance, and the processor may be further configured to monitor the measured illuminance value of the illuminance sensor, to when the measured illuminance value is changed to a low value, compare the measured illuminance value with the down hysteresis to identify whether the measured illuminance value exceeds the down hysteresis, and to when the measured illuminance value exceeds the down hysteresis and the predetermined time elapses, change the target luminance of the display based on the second threshold illuminance value.

The processor may be further configured to set the target luminance of the display based on the first threshold illuminance value when the illuminance sensor fails to output the measured illuminance value or outputs the measured illuminance value smaller than a specific range.

The electronic device may further include a memory configured to store at least one platform code corresponding to at least one luminance of the display and a plurality of threshold illumination values corresponding to the at least one platform code. The flag may contain a promised signal that instructs, upon detecting a designated platform code, to update the threshold illuminance value of current setting to the threshold illuminance value corresponding to the detected platform code.

The processor may be further configured to set the flag under a designated condition based on the plurality of threshold illuminance values and thereby update the threshold illuminance value.

The processor may be further configured to monitor the platform code while changing the luminance of the display, to set, based on the monitoring of the platform code, the flag for updating the threshold illuminance value when a boundary luminance is identified, to update the threshold illuminance value, based on the flag setting, and to change, based on the update of the threshold illuminance value, an integration time of the illuminance sensor 500 to an integration time corresponding to the updated threshold illuminance value.

The processor may be further configured to identify the boundary luminance based on whether a platform code corresponding to the luminance of the display is decreased from a current group to a boundary luminance of a next group, to when the boundary luminance is not identified, identify whether a current target luminance corresponds to a final luminance, and to when the current target luminance corresponds to the final luminance, determine the current target luminance as the final luminance to be changed.

The processor may be further configured to, when there is no change in the platform code according to the luminance of the display, determine a corresponding threshold illuminance value as a final threshold illuminance value and also determine a luminance corresponding to the final threshold illuminance value as a final target luminance.

The processor may be further configured to, when a value greater than or equal to the threshold illuminance value is acquired from the illuminance sensor, determine a corresponding threshold illuminance value as a final threshold illuminance value and also determine a luminance corresponding to the final threshold illuminance value as a final target luminance.

The processor may be further configured to change an integration time of the illuminance sensor to an integration time corresponding to the updated threshold illuminance value, based on the update of the threshold illuminance value.

The processor may be further configured to estimate the final luminance while increasing a time of changing the luminance of the display, based on the update of the threshold illuminance value.

The processor may be further configured to estimate the final luminance without changing a time of changing the luminance of the display, based on the update of the threshold illuminance value.

The display may include an active area and an inactive area, and the illuminance sensor may be disposed in the active area or the inactive area of the display.

Figure 8:
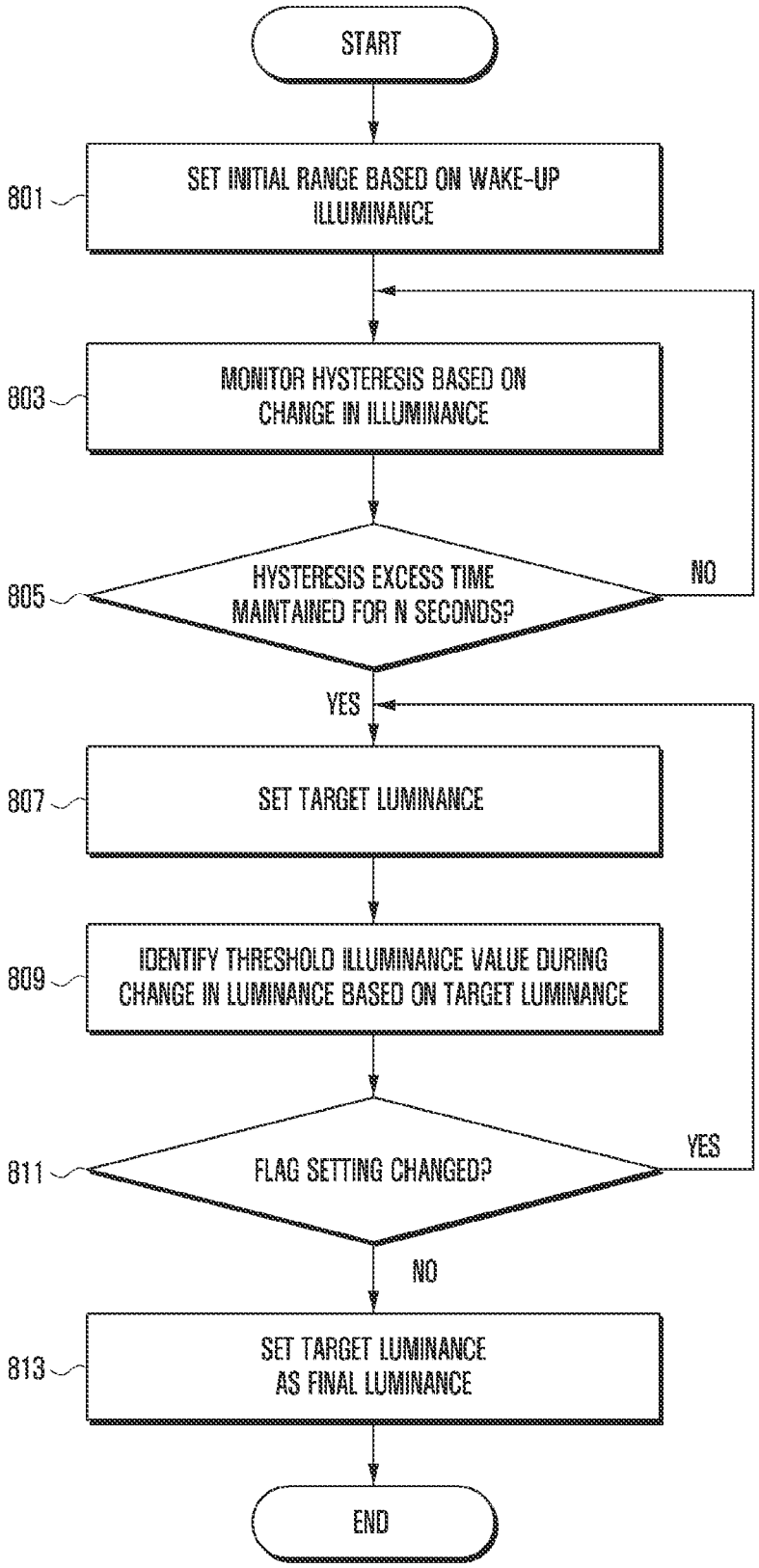
FIG. 8 illustrates an operating method of an electronic device according to embodiment.

FIG. 8 illustrates an operating method of an electronic device according to an embodiment.

Referring to FIG. 8, in step 801, the processor 120 of the electronic device 101 may set the luminance (or the initial range of a wake-up luminance) of the display 210, based on the wake-up illuminance. Based on detecting the wake-up (or power turn-on) of the display 210, the processor 120 may identify an illuminance value (or average value) immediately before the display 210 is turned on, that is, a wake-up illuminance. The processor 120 may set the initial range related to the luminance of the display 2:1.0 based on the identified wake-up illuminance. Based on the wake-up illuminance measured by the illuminance sensor 500 just before the display 210 wakes up, the processor 120 may set the luminance (e.g., wake-up luminance) of the corresponding illuminance value and control the display 210 to be turned on with a brightness corresponding to the set luminance. The wake-up luminance may indicate the luminance when the display 210 is turned on and may be set based on the wake-up luminance. In an embodiment, the initial range may include hysteresis (e.g., down hysteresis and up hysteresis) according to the wake-up illuminance. For example, the processor 120 may set the down hysteresis and the up hysteresis, based on the wake-up illuminance.

In step 803, the processor 120 may monitor hysteresis, based on a change in illuminance. The processor 120 may monitor a measured illuminance value of the illuminance sensor 500, compare the measured illuminance value with the down hysteresis when the measured illuminance value is changed (e.g., changed to a lower value), and thereby identify whether the measured illuminance value exceeds the down hysteresis.

In step 805, the processor 120 may determine whether a time for which the measured illuminance value exceeds the hysteresis is maintained for given N seconds (e.g., about 2 seconds), For example, the hysteresis may be operated when the corresponding illuminance value (e.g., down hysteresis) is exceeded for N seconds, and the luminance of the display 210 may be changed based on the average value of the measured illuminance value at that time or the first illuminance value thereafter, According to an embodiment, based on detecting a change in illuminance through the illuminance sensor 500, the processor 120 may acquire the measured illuminance value for N seconds (e.g., about 2 seconds) from the illuminance sensor 500 and determine whether the acquired illuminance value maintains the down hysteresis.

When the measured illuminance value does not exceed hysteresis or the excess time has not elapsed N seconds at the operation 805 (i.e., in case of 'No' in step 805), the processor 120 may return to the operation 803.

When the measured illuminance value exceeds hysteresis and N seconds elapse at the operation 805 (i.e., in case of 'Yes' in step 805), the processor 120 may set a target luminance of the display 210 in step 807, based on an average value of the measured illuminance values at the corresponding time point (e.g., after N seconds) or the first illuminance value. When the electronic device 101 enters a dark environment such as a darkroom, and thus when the illuminance sensor 500 does not output a measured illuminance value or outputs a measured illuminance value less than a certain range (e.g., about 0 lux to about 2 lux), the processor 120 may use a predetermined initial threshold illuminance value (e.g., $ML_5$ of about 10 lux) instead of the measured illuminance value of the illuminance sensor 500. For example, the processor 120 may set the target luminance of the display 210, based on the initial threshold illuminance value, According to another embodiment, when acquiring a value smaller than the initial threshold illuminance value (e.g., $ML_5$ of about 10 lux) from the illuminance sensor 500, the processor 120 may disregard the acquired value and identify the threshold illuminance value as an illuminance value applied to the illuminance sensor 500.

In step 809, while changing the luminance of the display 210 based on the target luminance, the processor 120 may identify a threshold illuminance value based on the changed luminance. For example, the processor 120 may change the luminance of the display 210 based on the target luminance and, during this change, determine whether the luminance (e.g., a platform code) of the display 210 reaches a luminance corresponding to the threshold illuminance value as shown in Table 2.

In step 811, the processor 120 may determine whether flag setting is changed. The flag is a variable indicating a changed state of the threshold illuminance value and may contain a promised signal (or command or predefined bit) that instructs, upon detecting a designated condition (e.g., a designated platform code), to update the current threshold illuminance value to the threshold illuminance value corresponding to the platform code. The processor 120 may declare one variable for the flag and store a state of updating the threshold illuminance value in the variable. The processor 120 may set a plurality of threshold illuminance values corresponding to the platform codes (or brightness levels) of the display 210 and, to update the threshold illuminance value, set flags under designated conditions based on the plurality of threshold illuminance values. For example, when identifying a designated (or initially set) threshold illuminance value through monitoring using the illuminance sensor 500 (e.g., when the measured illuminance value is a threshold illuminance value), the processor 120 may set a predetermined flag.

When the flag setting is not changed at the operation 811 (i.e., in case of 'No' in step 811), such as when a specific condition is not satisfied, the processor 120 may set in step 8:1.3 the target luminance as the final luminance to be changed.

When the flag setting is changed at the operation 811 (i.e., in case of 'Yes' in step 811), the processor 120 may return to the operation 807. For example, the processor 120 may change the target luminance of the display 210 to be suitable for the ambient light, based on the threshold illuminance value that varies. According to an embodiment, when the flag is set under a certain condition, the processor 120 may update the threshold illuminance value accordingly and then change the target luminance of the display 210, based on the updated threshold illuminance value.

Figure 9:
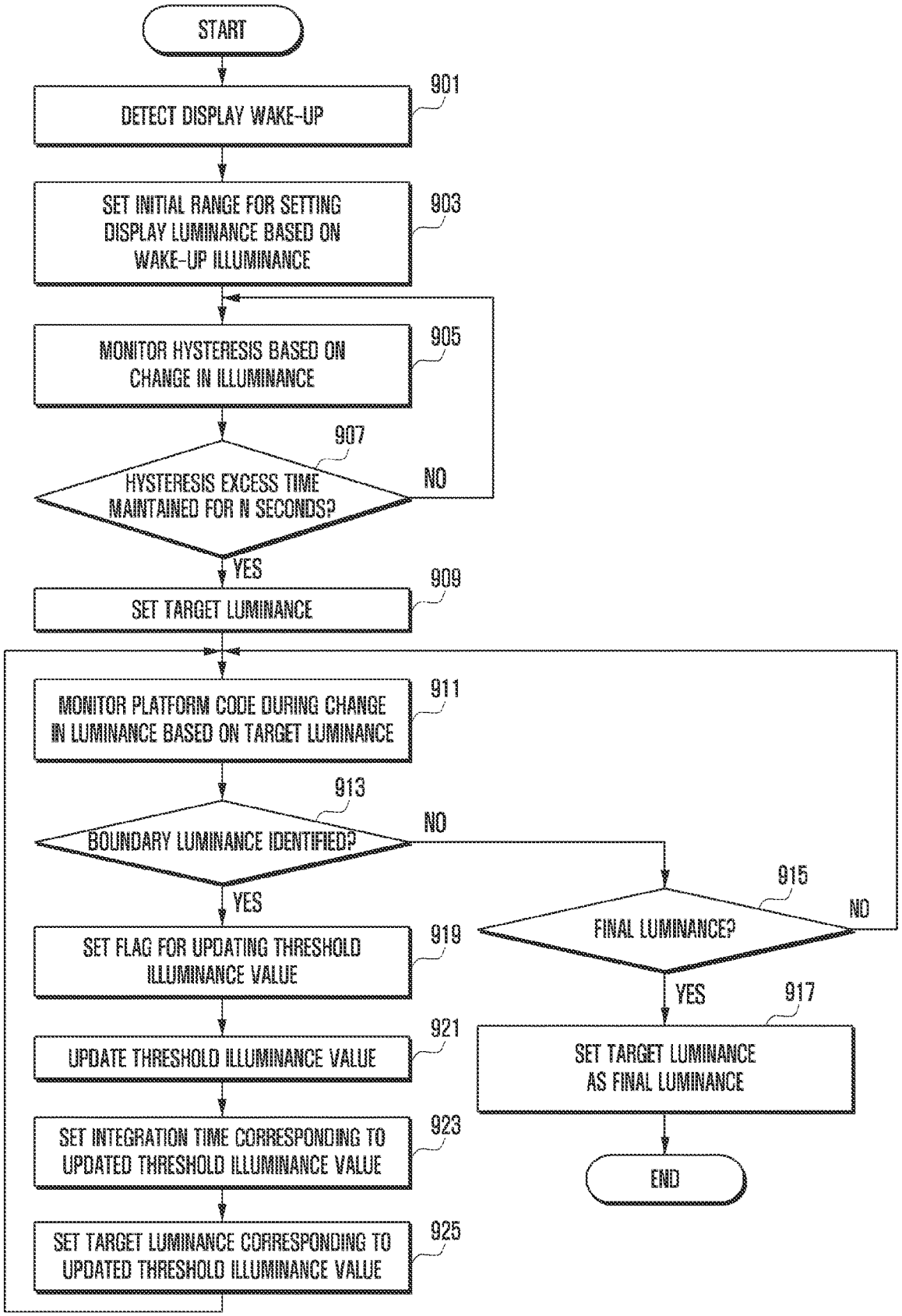
FIG. 9 illustrates an operating method of an electronic device according to an embodiment.

FIG. 9 illustrates an operating method of an electronic device according to an embodiment.

Referring to FIG. 9, in step 901, the processor 120 of the electronic device 101 may detect a wake-up (or power turn-on) of the display 210.

In step 903, the processor 120 may set the initial range for setting the luminance of the display 210, based on a wake-up illuminance. For example, the processor 120 may identify an illuminance value (or average value) immediately before the display 210 is turned on, that is, the wake-up illuminance, and set the initial range for changing the luminance of the display 210, based on the identified wake-up illuminance. Based on the wake-up illuminance measured by the illuminance sensor 500 just before the display 210 wakes up, the processor 120 may set the luminance (e.g., wake-up luminance) of the corresponding illuminance value and control the display 210 to be turned on with a brightness corresponding to the set luminance. The initial range may include hysteresis (e.g., down hysteresis and up hysteresis) according to the wake-up illuminance. For example, the processor 120 may set the down hysteresis and the up hysteresis, based on the wake-up illuminance.

In step 905, the processor 120 may monitor hysteresis, based on a change in illuminance. The processor 120 may monitor a measured illuminance value of the illuminance sensor 500, compare the measured illuminance value with the down hysteresis when the measured illuminance value is changed (e.g., changed to a lower value), and thereby identify whether the measured illuminance value exceeds the down hysteresis.

In step 907, the processor 120 may determine whether a e for which the measured illuminance value exceeds the hysteresis is maintained for a given N seconds (e.g., about 2 seconds), For example, based on detecting a change in illuminance through the illuminance sensor 500, the processor 120 may acquire the measured illuminance value for N seconds from the illuminance sensor 500 and determine whether the acquired illuminance value maintains the down hysteresis.

When the measured illuminance value does not exceed hysteresis or the excess time has not elapsed N seconds at the operation 907 (i.e., in case of 'No' in step 907), the processor 120 may return to the operation 905.

When the measured illuminance value exceeds hysteresis and N seconds elapse at the operation 907 (i.e., in case of 'Yes' in step 907), the processor 120 may set a target luminance of the display 210 in step 909, based on an average value of the measured illuminance values at the corresponding time point (e.g., after N seconds) or the first illuminance value. When the electronic device 101 enters a dark environment such as a darkroom, and thus when the illuminance sensor 500 does not output a measured illuminance value or outputs a measured illuminance value less than a certain range (e.g., about 0 lux to about 2 lux), the processor 120 may set the target luminance of the display 210, based on the initial threshold illuminance value (e.g., $ML_5$ of about 10 lux). According to another embodiment, when acquiring a value smaller than the initial threshold illuminance value (e.g., $ML_5$ of about 10 lux) from the illuminance sensor 500, the processor 120 may disregard the acquired value and identify the threshold illuminance value as an illuminance value applied to the illuminance sensor 500.

In step 911, while changing the luminance of the display 210 based on the target luminance, the processor 120 may monitor a platform code (or brightness level) of the display 210.

In step 913, based on monitoring of the platform code, the processor 120 may determine whether a boundary luminance is identified. For example, while controlling the brightness of the display 210 based on the target luminance, the processor 120 may identify whether the luminance code of the display 210 is decreased from a current group to the boundary luminance (or maximum luminance) of the next group.

When the boundary luminance is not identified at the operation 913 (i.e., in case of 'No' in step 913), the processor 120 may identify in step 915 whether the target luminance corresponds to the final luminance.

When there is no change in the platform code corresponding to the luminance of the display 210, the processor 120 may determine the corresponding threshold illuminance value as the final threshold illuminance value, and also determine the luminance corresponding to the final threshold illuminance value as the final target luminance. For example, when the flag setting related to the threshold illuminance value is no longer changed, the processor 120 may determine a predetermined luminance as the final target luminance of the display 210. In case of moving from about a 50 lux environment to a darkroom environment (e.g., about 0 lux to about 2 lux) as in the example of FIG. 6, the processor 120 may control the luminance of the display 210, based on a change (or update) up to the threshold illuminance value of the last stage (e.g., $ML_1$).

When acquiring an illuminance value greater than or equal to the threshold illuminance value from the illuminance sensor 500, the processor 120 may determine the threshold illuminance value as the final threshold illuminance value and also determine the luminance corresponding to the final threshold illuminance value as the final target luminance. For example, the flag setting related to the threshold illuminance value may be no longer changed, so that the processor 120 may determine a predetermined luminance as the final target luminance of the display 210, In case of moving from a 50 lux environment to an environment of a certain illuminance or more (e.g., M lux, which includes 5 lux or more and below the initial threshold illuminance value such as about 10 lux) as shown in the example of FIG. 7, the processor 120 may determine the final luminance of the display 210 based on the threshold illuminance value of an intermediate stage (e.g., ML2, ML3, ML4, or ML5) corresponding to a certain illuminance.

When the target luminance does not correspond to the final luminance at the operation 915 (i.e., in case of 'No' in step 915), the processor 120 may return to the operation 911.

When the target luminance corresponds to the final luminance at the operation 915 (i.e., in case of 'Yes' in step 915), the processor 120 may set in step 917 the target luminance as the final luminance to be changed.

When the boundary luminance is identified at step 913 (i.e., in case of 'Yes' in step 913), the processor 120 may set a flag for updating the threshold illumination value in step 919. The flag may contain a promised signal (or command or predefined bit) that instructs, upon detecting a designated condition (e.g., a designated platform code), to update the current threshold illuminance value to the threshold illuminance value corresponding to the platform code.

In step 921, the processor 120 may update the threshold illuminance value upon a change of the flag setting. The processor 120 may set a plurality of threshold illuminance values corresponding to the platform codes (or brightness levels) of the display 210 and, to update the threshold illuminance value, set flags under designated conditions based on the plurality of threshold illuminance values. For example, based on the flag, the processor 120 may update the threshold illuminance value of the illuminance sensor 500 to the threshold illuminance value of the identified group.

In step 923, the processor 120 may set an integration time corresponding to the updated threshold illuminance value. For example, as shown in Table 2, the processor 120 may set (or increase) the integration time of the illumination sensor 500 as the integration time of the corresponding group, based on the update of the threshold illumination value.

In step 925, the processor 120 may change a target luminance corresponding to the updated threshold illuminance value. For example, as shown in Table 2, the processor 120 may reset (or update the target luminance) the luminance corresponding to the updated threshold illuminance value as the target luminance, based on the update of the threshold illuminance value.

Steps 923 and 925 may be performed sequentially in the illustrated order, or alternatively performed in parallel, in reverse order, or heuristically. For example, in steps 923 and 925, setting the integration time and setting the target luminance may be performed in parallel based on the updated threshold illumination value, or setting the integration time setting operation may be performed after setting the target luminance.

Figure 10:
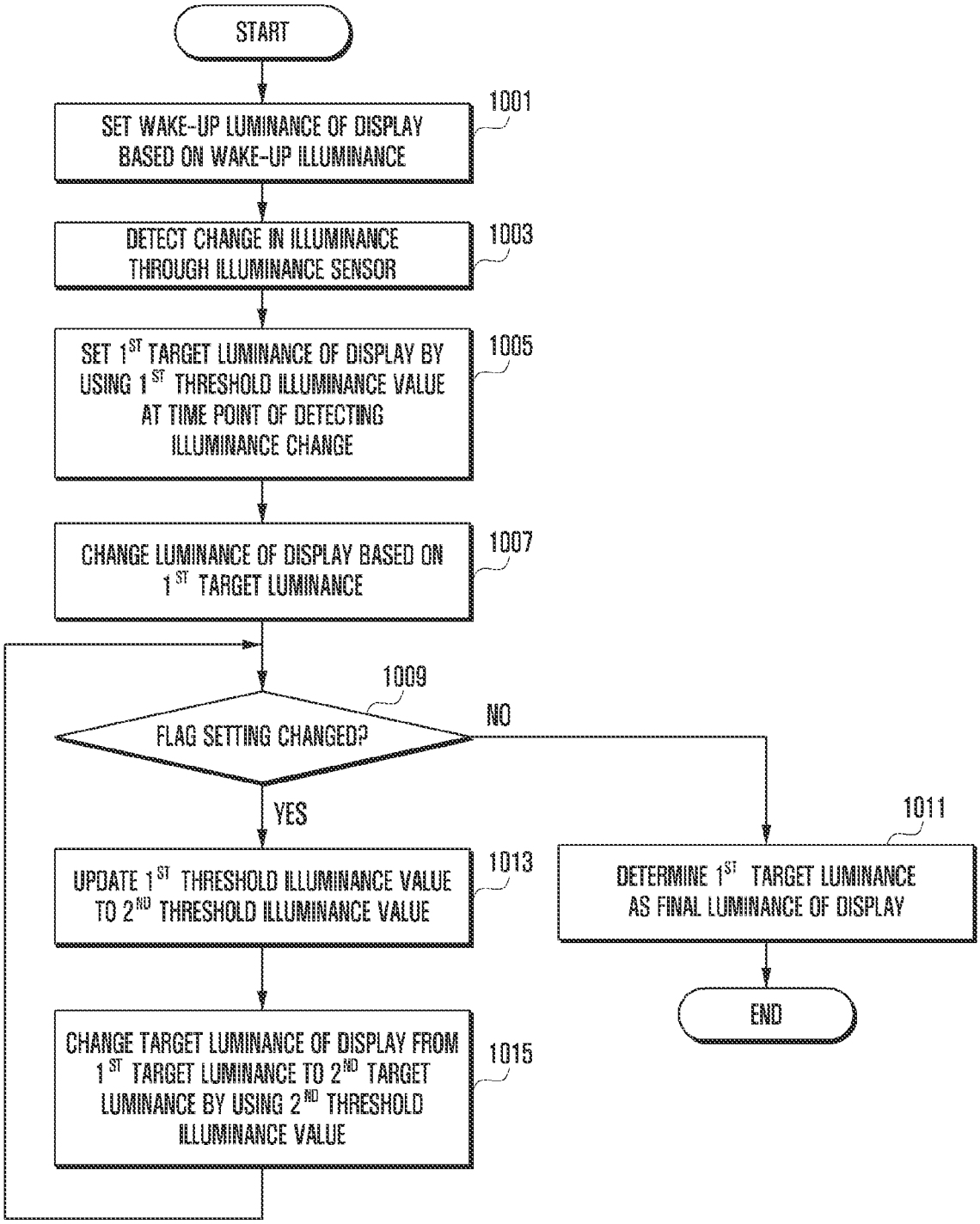
FIG. 10 illustrates an operating method of an electronic device according to an embodiment.

FIG. 10 illustrates an operating method of an electronic device according to an embodiment.

Referring to FIG. 10, in step 1001, the processor 120 of the electronic device 101 may set a wake-up luminance of the display 210, based on a wake-up illuminance. According to an embodiment, based on detecting the wake-up (or power turn-on) of the display 210, the processor 120 may identify an illuminance value (or average value) immediately before the display 210 is turned on, that is, the wake-up illuminance. The processor 120 may set the wake-up luminance of the display 210, based on the identified wake-up illuminance.

In step 1003, the processor 120 may detect (or monitor) a change in illuminance through the illuminance sensor 500.

In step 1005, based on detecting the illuminance change, the processor 120 may set a first target luminance of the display 210 by using a first threshold illuminance value at a time point of detecting the illuminance change.

In step 1007, the processor 120 may change the luminance of the display 210, based on the first target luminance.

In step 1009, while changing the luminance of the display 210 based on the first target luminance, the processor 120 may identify whether a flag setting related to an update of the threshold illuminance value is changed. The processor 120 may store platform codes each corresponding to the luminance of the display 210 and the threshold illuminance value in the memory 130 in the form of a table. The flag may contain a promised signal that instructs, upon detecting a designated platform code, to update the threshold illuminance value of the current setting to the threshold illuminance value corresponding to the detected platform code. The processor 120 may set flags under designated conditions based on a plurality of threshold illuminance values and thus update the threshold illuminance value. For example, the processor 120 may set a predetermined flag when identifying a designated (or initially set) threshold illuminance value through monitoring using the illuminance sensor 500 (e.g., when the measured illuminance value is a threshold illuminance value).

When there is no change in the flag setting at step 1009 (i.e., in case of 'No' in step 1009), the processor 120 may determine the first target luminance as the final luminance of the display 210 in step 1011.

When there is a change in the flag setting at the operation 1009 (i.e., in case of 'Yes' in step 1009), the processor 120 may update the first threshold illumination value to the second threshold illumination value. The processor 120 may update the threshold illuminance value upon identifying a change in the flag setting.

In step 1015, based on the update from the first threshold illumination value to the second threshold illumination value, the processor 120 may change the target luminance of the display 210 from the first target luminance to the second target by using the second threshold illumination value. For example, the processor 120 may change the target luminance of the display 210 to be suitable for the ambient light, based on the threshold illuminance value that varies.

Figure 11:
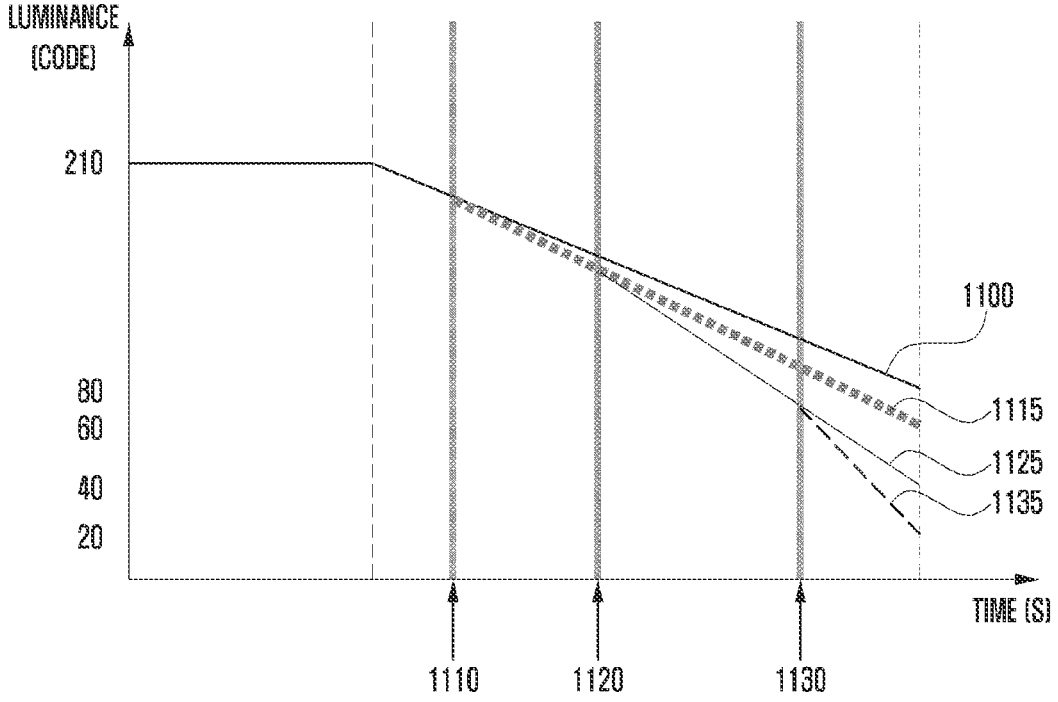
FIG. 11 illustrates an example of changing the luminance of a display in an electronic device according to an embodiment.

FIG. 11 illustrates an example of changing the luminance of a display in an electronic device according to an embodiment.

In FIG. 11, when the threshold illuminance value is updated, the electronic device 101 (or the processor 120) may estimate the final luminance while increasing a time of changing the luminance of the display 210. According to another embodiment, when the threshold illuminance value is updated, the electronic device 101 may estimate the final luminance without changing a time of changing the luminance of the display 210. For example, as shown in FIG. 11, slopes 1100, 1115, 1125, and 1135 indicating the luminance changes may be varied at each time point 1110, 1120, or 1130 at which the threshold illuminance value is updated. The electronic device 101 may change the slopes 1100, 1115, 1125, and 1135 so as to change the luminance within a specific time (e.g., quickly change the luminance). For example, the slopes 1100, 1115, 1125, and 1135 of the luminance changes may be set differently so that the time of changing the luminance is maintained even if the threshold illuminance value is updated.

When moving from an environment of about 50 lux to a darkroom (e.g., about 0 lux to about 2 lux), the electronic device 101 may control the luminance of the display 210 based on a change (or update) up to the threshold illuminance value of the last stage. When moving from a 50 lux environment to an environment of a certain illuminance or more (e.g., M lux, which includes 5 lux or more and below the initial threshold illuminance value such as about 10 lux), the electronic device 101 may determine the final luminance of the display 210 based on the threshold luminance value (e.g., an environment of about 6 lux to about 8 lux) of an intermediate stage corresponding to a certain luminance.

As described above, an operating method of an electronic device may include setting a wake-up luminance of a display, based on a wake-up illuminance; setting, upon detecting an illuminance change through an illuminance sensor, a first target luminance of the display by using a first threshold illuminance value at a time point of detecting the illuminance change; identifying whether a flag setting related to an update of a threshold illuminance value is changed, while changing a luminance of the display based on the first target luminance; determining the first target luminance as a final luminance of the display when there is no change in the flag setting; updating the first threshold illuminance value to a second threshold illuminance value when there is a change in the flag setting; and changing a target luminance of the display from the first target luminance to a second target luminance by using the second threshold illuminance value.

The method may further include monitoring a hysteresis based on the illuminance change; and determining the target luminance of the display by using the first threshold illuminance value instead of the measured illuminance value of the illuminance sensor when the measured illuminance value exceeds the hysteresis for a predetermined time.

The method may further include monitoring a platform code while changing the luminance of the display; based on the monitoring of the platform code, setting the flag for updating the threshold illuminance value when a boundary luminance is identified; and updating the threshold illuminance value, based on the flag setting, wherein the platform includes at least one platform code corresponding to at least one luminance of the display, and a plurality of threshold illumination values corresponding to the at least one platform code are set, and wherein the flag contains a promised signal that instructs, upon detecting a designated platform code, to update the threshold illuminance value of current setting to the threshold illuminance value corresponding to the detected platform code.

The method may further include identifying the boundary luminance based on whether a platform code corresponding to the luminance of the display is decreased from a current group to a boundary luminance of a next group; when the boundary luminance is not identified, identifying whether a current target luminance corresponds to a final luminance; and when the current target luminance corresponds to the final luminance, determining the current target luminance as the final luminance to be changed.

Determining the final luminance may include, when there is no change in the platform code according to the luminance of the display, determining a corresponding threshold illuminance value as a final threshold illuminance value, or when a value greater than or equal to the threshold illuminance value is acquired from the illuminance sensor, determining a corresponding threshold illuminance value as a final threshold illuminance value, and then determining a luminance corresponding to the final threshold illuminance value as a final target luminance.

The method may further include changing an integration time of the illuminance sensor to an integration time corresponding to the updated threshold illuminance value, based on the update of the threshold illuminance value; estimating the final luminance while increasing a time of changing the luminance of the display, based on the update of the threshold illuminance value; and estimating the final luminance without changing a time of changing the luminance of the display, based on the update of the threshold illuminance value.

While the disclosure has been particularly shown and described with reference to certain embodiments thereof, it will be understood by those skilled in the art that various changes in form and details may be made therein without departing from the scope of the subject matter as defined by the appended claims.

What is claimed is:

1. An electronic device, comprising:

a display;

an illuminance sensor; and a processor configured to:

set a wake-up luminance of the display, based on a wake-up illuminance, monitor a hysteresis, upon detecting an illuminance change through the illuminance sensor, set a first target luminance of the display by using a first threshold illuminance value corresponding to a measured illuminance value of the illuminance sensor when the measured illuminance value exceeds the hysteresis for a predetermined time, identify whether a flag setting related to an update of a threshold illuminance value is changed, while changing a luminance of the display based on the first target luminance, determine the first target luminance as a final luminance of the display when there is no change in the flag setting, update the first threshold illuminance value to a second threshold illuminance value when there is a change in the flag setting, and change a target luminance of the display from the first target luminance to a second target luminance by using the second threshold illuminance value.

2. The electronic device of claim 1, wherein the processor is further configured to:

identify, as the wake-up illuminance, an illuminance value measured by the illuminance sensor immediately before the display is turned on, based on detecting a wake-up of the display, set an initial range of the wake-up luminance of the display, based on the wake-up illuminance, and control the display to be turned on with brightness corresponding to the wake-up luminance, and wherein the initial range includes the hysteresis depending on the wake-up illuminance.

3. The electronic device of claim 1, wherein the hysteresis includes down hysteresis and up hysteresis which are set based on the wake-up illuminance, and wherein the processor is further configured to:

monitor the measured illuminance value of the illuminance sensor, compare, when the measured illuminance value is changed to a low value, the measured illuminance value with the down hysteresis to identify whether the measured illuminance value exceeds the down hysteresis, and change, when the measured illuminance value exceeds the down hysteresis and the predetermined time elapses, the target luminance of the display based on the second threshold illuminance value.

4. The electronic device of claim 1, wherein the processor is further configured to set the target luminance of the display based on the first threshold illuminance value when the illuminance sensor fails to output the measured illuminance value or outputs the measured illuminance value less than a specific range.

5. The electronic device of claim 1, further comprising a memory, wherein the memory is configured to store at least one platform code corresponding to at least one luminance of the display and a plurality of threshold illumination values corresponding to the at least one platform code, and wherein the flag contains a signal that instructs, upon detecting a designated platform code, to update the threshold illuminance value of current setting to the threshold illuminance value corresponding to the detected platform code.

6. The electronic device of claim 5, wherein the processor is further configured to set the flag under a designated condition based on the plurality of threshold illuminance values and thereby update the threshold illuminance value.

7. The electronic device of claim 5, wherein the processor is further configured to:

monitor the platform code while changing the luminance of the display, based on the monitoring of the platform code, set the flag for updating the threshold illuminance value when a boundary luminance is identified, update the threshold illuminance value, based on the flag setting, and based on the update of the threshold illuminance value, change an integration time of the illuminance sensor to an integration time corresponding to the updated threshold illuminance value.

8. The electronic device of claim 7, wherein the processor is further configured to:

identify the boundary luminance based on whether a platform code corresponding to the luminance of the display is decreased from a current group to a boundary luminance of a next group, when the boundary luminance is not identified, identify whether a current target luminance corresponds to a final luminance, and when the current target luminance corresponds to the final luminance, determine the current target luminance as the final luminance to be changed.

9. The electronic device of claim 8, wherein the processor is further configured to, when there is no change in the platform code according to the luminance of the display, determine a corresponding threshold illuminance value as a final threshold illuminance value and also determine a luminance corresponding to the final threshold illuminance value as a final target luminance.

10. The electronic device of claim 8, wherein the processor is further configured to, when a value greater than or equal to the threshold illuminance value is acquired from the illuminance sensor, determine a corresponding threshold illuminance value as a final threshold illuminance value and also determine a luminance corresponding to the final threshold illuminance value as a final target luminance.

11. The electronic device of claim 1, wherein the processor is further configured to change an integration time of the illuminance sensor to an integration time corresponding to the updated threshold illuminance value, based on the update of the threshold illuminance value.

12. The electronic device of claim 1, wherein the processor is further configured to estimate the final luminance while increasing a time of changing the luminance of the display, based on the update of the threshold illuminance value.

13. The electronic device of claim 1, wherein the processor is further configured to estimate the final luminance without changing a time of changing the luminance of the display, based on the update of the threshold illuminance value.

14. The electronic device of claim 1, wherein the display includes an active area and an inactive area, and wherein the illuminance sensor is disposed in the active area or the inactive area of the display.

15. The electronic device of claim 1, wherein the first threshold illuminance value corresponds to an initial illuminance value after the predetermined time.

16. An operating method of an electronic device, the method comprising:

setting a wake-up luminance of a display, based on a wake-up illuminance;

monitoring a hysteresis, upon detecting an illuminance change through an illuminance sensor, setting a first target luminance of the display by using a first threshold illuminance value corresponding to a measured illuminance value of the illuminance sensor when the measured illuminance value exceeds the hysteresis for a predetermined time;

identifying whether a flag setting related to an update of a threshold illuminance value is changed, while changing a luminance of the display based on the first target luminance;

determining the first target luminance as a final luminance of the display when there is no change in the flag setting;

updating the first threshold illuminance value to a second threshold illuminance value when there is a change in the flag setting; and changing a target luminance of the display from the first target luminance to a second target luminance by using the second threshold illuminance value.

17. The method of claim 16, further comprising:

monitoring a platform code while changing the luminance of the display;

based on the monitoring of the platform code, setting the flag for updating the threshold illuminance value when a boundary luminance is identified; and updating the threshold illuminance value, based on the flag setting, wherein the platform includes at least one platform code corresponding to at least one luminance of the display, and a plurality of threshold illumination values corresponding to the at least one platform code are set, and wherein the flag contains a promised signal that instructs, upon detecting a designated platform code, to update the threshold illuminance value of current setting to the threshold illuminance value corresponding to the detected platform code.

18. The method of claim 17, further comprising:

identifying the boundary luminance based on whether a platform code corresponding to the luminance of the display is decreased from a current group to a boundary luminance of a next group;

when the boundary luminance is not identified, identifying whether a current target luminance corresponds to a final luminance; and when the current target luminance corresponds to the final luminance, determining the current target luminance as the final luminance to be changed, wherein determining the final luminance includes:

when there is no change in the platform code according to the luminance of the display, determining a corresponding threshold illuminance value as a final threshold illuminance value, or when a value greater than or equal to the threshold illuminance value is acquired from the illuminance sensor, determining a corresponding threshold illuminance value as a final threshold illuminance value, and then determining a luminance corresponding to the final threshold illuminance value as a final target luminance.

19. The method of claim 17, further comprising:

changing an integration time of the illuminance sensor to an integration time corresponding to the updated threshold illuminance value, based on the update of the threshold illuminance value;

estimating the final luminance while increasing a time of changing the luminance of the display, based on the update of the threshold illuminance value; and estimating the final luminance without changing a time of changing the luminance of the display, based on the update of the threshold illuminance value.

20. The method of claim 16, wherein the first threshold illuminance value corresponds to an initial illuminance value after the predetermined time.

* * * * *